US011455841B1

(12) United States Patent
Brunda et al.

(10) Patent No.: US 11,455,841 B1
(45) Date of Patent: Sep. 27, 2022

(54) SYSTEM AND METHOD FOR SELECTIVE VEHICLE DATA RETRIEVAL

(71) Applicant: Innova Electronics Corporation, Irvine, CA (US)

(72) Inventors: Bruce B. Brunda, Newport Beach, CA (US); David Rich, Huntington Beach, CA (US); Hoa Chau, Irvine, CA (US); Jason Javaherian, Los Angeles, CA (US); Phuong Pham, Fountain Valley, CA (US)

(73) Assignee: Innova Electronics Corporation, Irvine, CA (US)

( * ) Notice: Subject to any disclaimer, the term of this patent is extended or adjusted under 35 U.S.C. 154(b) by 0 days.

(21) Appl. No.: 17/675,176

(22) Filed: Feb. 18, 2022

Related U.S. Application Data

(63) Continuation-in-part of application No. 17/458,154, filed on Aug. 26, 2021, now Pat. No. 11,335,139.

(51) Int. Cl.
*G07C 5/00* (2006.01)
*G07C 5/08* (2006.01)

(52) U.S. Cl.
CPC ..... *G07C 5/008* (2013.01); *G07C 5/0808* (2013.01); *G07C 5/0816* (2013.01)

(58) Field of Classification Search
CPC ..... G07C 5/008; G07C 5/0808; G07C 5/0816
See application file for complete search history.

(56) References Cited

U.S. PATENT DOCUMENTS 5,020,135 A 5/1991 Kasparian et al.
D334,560 S 4/1993 Wilson
5,347,211 A 9/1994 Jakubowski
(Continued)

FOREIGN PATENT DOCUMENTS

KR 100456024 B1 10/2004
WO 1999023783 A2 10/1998
(Continued)

OTHER PUBLICATIONS

SPX Corporation, Genisys Evo catalog, 2011, 8 pages.

*Primary Examiner* — Michael V Kerrigan
(74) *Attorney, Agent, or Firm* — Stetina Brunda Garred & Brucker

(57) ABSTRACT

A system for providing mobile application-based vehicle diagnostics includes a mobile communication device ("device") having an installed mobile application ("app"). The app receives an instruction to obtain vehicle condition information of a vehicle, determines a geolocation of the device, and displays a geolocation of a diagnostic service provider on the device. A diagnostic tool operable by the diagnostic service provider retrieves diagnostic data from the vehicle. A server operable by a different entity than the diagnostic service provider establishes a user profile associated with a user of the device and including a vehicle identification number (VIN) of the vehicle, receives the diagnostic data from the diagnostic tool, detects the VIN in the diagnostic data, derives vehicle condition information from the diagnostic data, associates the vehicle condition information with the user profile by matching the VIN, and provides the vehicle condition information to the app to be displayed on the device.

49 Claims, 6 Drawing Sheets

(56) References Cited

U.S. PATENT DOCUMENTS

| | | | |
|---|---|---|---|
| 5,499,182 | A | 3/1996 | Ousborne |
| 5,541,840 | A | 7/1996 | Krzysztof et al. |
| D377,622 | S | 1/1997 | Chen et al. |
| 5,623,922 | A | 4/1997 | Smith |
| 5,635,841 | A | 6/1997 | Taylor |
| 5,671,141 | A | 9/1997 | Smith et al. |
| 5,758,300 | A | 5/1998 | Abe |
| 5,767,681 | A | 6/1998 | Huang |
| 5,794,164 | A | 8/1998 | Beckert et al. |
| 5,808,907 | A | 9/1998 | Shetty et al. |
| 5,809,437 | A | 9/1998 | Breed |
| 5,848,365 | A | 12/1998 | Coverdill |
| 5,859,628 | A | 1/1999 | Ross et al. |
| 5,884,202 | A | 3/1999 | Arjomand |
| 6,000,413 | A | 12/1999 | Chen |
| 6,052,631 | A | 4/2000 | Busch et al. |
| 6,055,468 | A | 4/2000 | Kaman et al. |
| 6,094,609 | A | 7/2000 | Arjomand |
| 6,104,988 | A | 8/2000 | Klarer |
| 6,225,898 | B1 | 5/2001 | Kamiya et al. |
| 6,263,268 | B1 | 7/2001 | Nathanson |
| 6,295,492 | B1 | 9/2001 | Lang et al. |
| 6,314,422 | B1 | 11/2001 | Barker et al. |
| 6,389,337 | B1 | 5/2002 | Kolls |
| 6,438,471 | B1 | 8/2002 | Katagishi et al. |
| 6,442,460 | B1 | 8/2002 | Larson et al. |
| 6,499,385 | B2 | 12/2002 | Protti |
| 6,535,112 | B1 | 3/2003 | Rothschink |
| 6,587,768 | B2 | 7/2003 | Chene et al. |
| 6,611,740 | B2 | 8/2003 | Lowrey et al. |
| 6,650,318 | B1 | 11/2003 | Amon |
| 6,718,425 | B1 | 4/2004 | Pajakowski et al. |
| 6,732,031 | B1 | 5/2004 | Lightner et al. |
| 6,738,697 | B2 | 5/2004 | Breed |
| 6,768,935 | B1 | 7/2004 | Morgan et al. |
| 6,807,469 | B2 | 10/2004 | Funkhouser et al. |
| 6,836,708 | B2 | 12/2004 | Tripathi |
| 6,847,916 | B1 | 1/2005 | Ying |
| 6,868,369 | B2 | 3/2005 | Huang et al. |
| 6,925,368 | B2 | 8/2005 | Funkhouser et al. |
| 6,940,270 | B2 | 9/2005 | Chen |
| D510,287 | S | 10/2005 | Chen et al. |
| 6,957,133 | B1 | 10/2005 | Hunt et al. |
| 6,968,733 | B2 | 11/2005 | Andreasen et al. |
| 7,030,742 | B2 | 4/2006 | Treadway |
| 7,085,680 | B2 | 8/2006 | Huang |
| 7,089,099 | B2 | 8/2006 | Shostak et al. |
| 7,103,460 | B1 | 9/2006 | Breed |
| 7,116,216 | B2 | 10/2006 | Andreasen et al. |
| 7,209,813 | B2 | 4/2007 | Namaky |
| D545,223 | S | 6/2007 | Chen |
| D558,621 | S | 1/2008 | Rich et al. |
| D559,137 | S | 1/2008 | Protti |
| D560,129 | S | 1/2008 | Rich et al. |
| D560,527 | S | 1/2008 | Rich et al. |
| 7,325,775 | B2 | 2/2008 | Chen |
| D563,249 | S | 3/2008 | Chen |
| 7,363,149 | B2 | 4/2008 | Klausner et al. |
| D569,280 | S | 5/2008 | Chen |
| 7,376,497 | B2 | 5/2008 | Chen |
| D571,241 | S | 6/2008 | Andreasen et al. |
| 7,409,317 | B2 | 8/2008 | Cousin et al. |
| 7,421,321 | B2 | 9/2008 | Breed et al. |
| 7,437,227 | B2 | 10/2008 | Andreasen et al. |
| D581,822 | S | 12/2008 | Madison et al. |
| 7,464,000 | B2 | 12/2008 | Huang |
| D590,387 | S | 4/2009 | Chen |
| 7,520,668 | B2 | 4/2009 | Chen |
| 7,603,293 | B2 | 10/2009 | Chenn |
| 7,620,484 | B1 | 11/2009 | Chen |
| D610,586 | S | 2/2010 | Chen |
| 7,778,750 | B2 | 8/2010 | Knight et al. |
| D624,446 | S | 9/2010 | Chen et al. |
| D624,838 | S | 10/2010 | Chen et al. |
| D625,209 | S | 10/2010 | Chen et al. |
| D625,210 | S | 10/2010 | Chen et al. |
| D625,634 | S | 10/2010 | Chen et al. |
| 7,904,219 | B1 | 3/2011 | Lowrey et al. |
| 8,019,503 | B2 | 9/2011 | Andreasen et al. |
| 8,024,083 | B2 | 9/2011 | Chenn |
| D646,188 | S | 10/2011 | Chen et al. |
| D646,599 | S | 10/2011 | Chen et al. |
| 8,032,419 | B2 | 10/2011 | Chenn |
| 8,068,951 | B2 | 11/2011 | Chen et al. |
| 8,131,417 | B2 | 3/2012 | Picard |
| 8,301,329 | B2 | 10/2012 | Andreasen et al. |
| 8,306,687 | B2 | 11/2012 | Chen |
| 8,370,018 | B2 | 2/2013 | Andreasen et al. |
| 8,509,986 | B1 | 8/2013 | Chen |
| 8,630,765 | B2 | 1/2014 | Chen |
| 8,825,271 | B2 | 9/2014 | Chen |
| 8,855,621 | B2 | 10/2014 | Chen |
| 8,862,117 | B2 | 10/2014 | Chen |
| 8,909,416 | B2 | 12/2014 | Chen et al. |
| 9,002,554 | B2 | 4/2015 | Chen |
| 9,014,908 | B2 | 4/2015 | Chen et al. |
| 9,026,400 | B2 | 5/2015 | Chen et al. |
| 9,177,428 | B2 | 11/2015 | Nguyen et al. |
| 9,646,432 | B2 | 5/2017 | Madison et al. |
| 10,643,403 | B2 | 5/2020 | Madison et al. |
| 2001/0033225 | A1 | 10/2001 | Razavi et al. |
| 2002/0007237 | A1 | 1/2002 | Phung et al. |
| 2002/0010541 | A1 | 1/2002 | Houston et al. |
| 2002/0035421 | A1 | 3/2002 | Warkentin |
| 2003/0171111 | A1 | 9/2003 | Clark |
| 2004/0110472 | A1 | 6/2004 | Witkowski et al. |
| 2004/0227523 | A1 | 11/2004 | Namaky |
| 2005/0192727 | A1 | 9/2005 | Shostak et al. |
| 2009/0276115 | A1 | 11/2009 | Chen |
| 2011/0071720 | A1 | 3/2011 | Schondorf et al. |
| 2011/0123039 | A1 | 5/2011 | Hirschfeld et al. |
| 2011/0224866 | A1 | 9/2011 | Chen |
| 2011/0264322 | A1 | 10/2011 | Chen |
| 2011/0307144 | A1 | 12/2011 | Wu et al. |
| 2012/0215398 | A1 | 8/2012 | Chen et al. |
| 2013/0297143 | A1 | 11/2013 | Chen et al. |
| 2013/0338873 | A1* | 12/2013 | Baalu ..... G06Q 30/08 701/31.4 |
| 2014/0046800 | A1 | 2/2014 | Chen |
| 2014/0052328 | A1 | 2/2014 | Nguyen et al. |
| 2019/0304208 | A1 | 10/2019 | Chen et al. |
| 2019/0304213 | A1 | 10/2019 | Chen et al. |

FOREIGN PATENT DOCUMENTS

| | | | |
|---|---|---|---|
| WO | 1998051991 | A1 | 11/1998 |
| WO | 2001086576 | A1 | 11/2001 |

* cited by examiner

SYSTEM AND METHOD FOR SELECTIVE VEHICLE DATA RETRIEVAL

CROSS-REFERENCE TO RELATED APPLICATIONS

This application is a continuation-in-part of U.S. patent application Ser. No. 17/458,154, filed Aug. 26, 2021 and entitled "SYSTEM AND METHOD FOR SELECTIVE VEHICLE DATA RETRIEVAL," the entire contents of which is expressly incorporated by reference herein.

STATEMENT RE: FEDERALLY SPONSORED RESEARCH/DEVELOPMENT

Not Applicable

BACKGROUND

Technical Field

The present disclosure relates to vehicle diagnostic products and services, and more particularly, to a method, system, and application program directed to retrieving, retaining and utilizing vehicle specific diagnostic information using either an on-board device for communicating with the vehicle diagnostic system, or, where no such device is available, using a network of diagnostic service providers that retrieve and upload the vehicle data to a processor operative to detect and aggregate all vehicle data received from one or more registered vehicles.

Related Art

Due to the complexity of automotive technology, the rough handling that a vehicle ordinarily endures, and the importance of safety and performance to vehicle owners, vehicle ownership invariably requires periodic servicing of the vehicle. To most vehicle owners, servicing the vehicle entails bringing the vehicle to an expert, typically either a dealership or a trusted, independent auto mechanic. To some do-it-yourselfers (DIYers), servicing the vehicle may entail diagnosing the vehicle using state-of-the-art vehicle diagnostics technology that is compatible with automotive scan tools and consumer mobile devices such as smartphones, for example, and then purchasing auto parts to perform the necessary repairs oneself. In any case, there are occasions when it becomes necessary to seek service and/or part providers outside the habitual patterns of the vehicle owner. This is true even for the most passionate DIYer or the most risk-averse vehicle owner who consistently takes his or her vehicle to the dealership where it was purchased. Cars break down unexpectedly requiring roadside assistance, rare or difficult-to-diagnose defects are encountered, and vehicle owners travel far from their usual service and part providers. Moreover, vehicles change owners, with the different owners having different preferences and habits. As a result, during the life of a vehicle, the many accumulated repair and/or diagnostic "events" will have occurred at a wide variety of locations and will have been handled by a vast array of disparate service providers.

From the perspective of any one automotive service provider who might wish to establish a lasting relationship with the vehicle owner, this makes it exceedingly difficult to acquire and maintain a thorough understanding of the vehicle's condition and history. For example, a provider of automotive diagnostic and repair services might want to provide value to its customers by offering individually tailored services and enhanced diagnostics that take into account information about each particular vehicle. To do this, they might use loyalty and reward programs to entice the vehicle owner to always take the vehicle to them for repairs and/or parts. However, this approach inevitably fails in the long term as the vehicle owner is forced to take the vehicle elsewhere by events outside his or her control. Another approach that may be taken is to encourage the customer to purchase a scan tool or other device that the customer can use to diagnose the vehicle by himself or herself. The service provider can then maintain a proprietary database of vehicle condition reports derived from customer diagnostic data that is retrieved from the customers' vehicles and uploaded using the scan tools. However, these devices are expensive and not likely to be bought by the average consumer, making it difficult to build such a database for a significant portion of the customer base. Service providers are left with two unsatisfactory outcomes: on the one hand, providing enhanced services to only a small portion of the customer base and, on the other, providing more generic (and less valuable) services to the majority of customers. This unfortunate state of affairs can be seen if one looks at the automotive mobile applications that exist on the market today. Though such apps purport to provide targeted assistance to all vehicle owners, they either require a connection to a vehicle ECU using a dongle or other data acquisition device or else offer little more than generic information that is of little value to a driver in need of assistance.

From the vehicle owner's perspective, the problem is greater still. Vehicle owners want the same individualized services that the service providers would like to provide them with, and, for the most part, they would prefer not to have to buy additional devices besides the smartphones that they already have. But in addition, even for those vehicle owners who would be willing to buy a scan tool or dongle and upload diagnostic data to a service provider's database, there are times when the vehicle owner would prefer not to use this device and would rather seek expert assistance. For example, the vehicle owner may find the dongle inconvenient to use because it drains the vehicle battery if it is left plugged into the OBD port while the vehicle is off. Not wanting to have to remember to unplug the dongle every time he or she turns off the vehicle (and plug it back in when the vehicle is in use), the customer may decide to forgo the use of the dongle altogether or may decide that it is sometimes worth using but other times not. As another example, the vehicle owner may want to obtain multiple scans of their vehicle diagnostic data to notice any differences or trends in the operation of vehicle systems, that may indicate a defect condition is deteriorating further. Further, a vehicle owner may simply want a second opinion and may seek diagnostic services of an expert mechanic in addition to the scan that the vehicle owner performed himself or herself. In general, vehicle owners want the freedom to choose how, when, and where to diagnose and service their vehicles using a common diagnostic portal that integrates vehicle information obtained at different diagnostic service providers, that can all be accessed by the vehicle owner using a single application program. This is something that conventional models cannot provide, even to those customers willing to purchase a scan tool or dongle.

Moreover, vehicle owners want to keep a record of their own data. Even when conventional systems work as intended, e.g., with each customer diagnosing his or her own vehicle and uploading the resulting data to build an individualized record, the resulting record is typically not readily accessible to the customer. For example, the vehicle owner may want to view a past vehicle condition report and forward the report to a trusted auto mechanic for further recommendations. Assuming that it is possible for the vehicle owner to see this information at all, the vehicle owner may typically have to contact the service provider via customer service channels in order to gain access to the information. From the perspective of the vehicle owner, who is unconcerned with the business needs of the service provider, it would be better if all the information about his or her vehicle were always at the vehicle owner's fingertips, accessible within a mobile app for any purpose the vehicle owner may have in mind.

The ideal system would solve all of the above problems. A vehicle owner should be free to decide whether to diagnose his or her own vehicle using a scan tool or dongle or to take the vehicle to an expert mechanic of his or her choice. In some instances, the vehicle owner may decide to use a kiosk-based diagnostic system provided at an auto parts store or vehicle service center. The decision should be made freely depending on the circumstances, with the vehicle owner perhaps choosing one route one day and another route the next. If the vehicle does not own or does not choose to use a scan tool or dongle, the app should assist the user with finding a vehicle diagnostics services provider to scan the vehicle. Regardless of how and where the vehicle owner seeks diagnostic and repair services, buys auto parts, or requests roadside assistance, all of the resulting diagnostic data and derived vehicle condition reports should be made available to the user automatically or on demand over the vehicle owner's smart phone or other mobile device. An app installed on the device should make use of all of this accumulated information to provide targeted recommendations to the vehicle owner that are specific to the vehicle including its up-to-date diagnostic condition information collected from disparate sources. The app should empower the vehicle owner while at the same time benefiting business owners by driving vehicle owners to local auto mechanics, parts stores, and roadside assistance service providers.

Moreover, the ideal app would provide additional value by taking full advantage of native mobile device capabilities such as cameras, GPS, accelerometers, and microphones, to name a few. Such powerful capabilities should be fully integrated into the system in a way that treats the mobile device as another sensor for diagnostic data collection and, in doing so, augments the available diagnostic services without detracting from the convenience of the user experience. At the same time, the app should serve as a way for a provider of the system to communicate with the customers using the app and, for example, to present information and offers that are of immediate relevance to the customer as the customer goes about his/her day and as the customer's habits and circumstances change over time. The usefulness of the app should not be limited to those times when the customer is experiencing difficulty with his/her vehicle but should be the user's go-to app for advice, recommendations, and day-to-day convenience in addition to emergencies.

BRIEF SUMMARY

The present disclosure contemplates various systems and methods for overcoming the above drawbacks accompanying the related art. The present disclosure addresses a need for a diagnostic network architecture that allows app users to aggregate their vehicle diagnostic data and derived vehicle condition information in a common storage area, where it can be accessed, analyzed and acted on by the app user. Preferably such aggregation may be implemented, on an ongoing basis, independent of any user interaction with the app user interface. User activity would be limited to providing an instruction to obtain a diagnostic information scan and selecting a nearby diagnostic service provider that provides a diagnostic data inspection (preferably free of charge), which uploads the diagnostic information to a processor that, in addition to returning the diagnostic report to the providing diagnostic service provider, also detects diagnostic data/information associated with a registered vehicle and routes the data/information to the user, or to a storage location associated with the user. The intended result is to enable the generation of a diagnostic report for a vehicle, that doesn't have a dongle or other data access and transfer device, that essentially replicates a report generated for a vehicle having an associated data collecting dongle or other device.

One aspect of the embodiments of the present disclosure is a non-transitory program storage medium on which are stored instructions executable by a processor or programmable circuit of a mobile communication device to perform operations for mobile application-based vehicle diagnostics. The operations may comprise establishing a user profile associated with a user of the mobile communication device, the profile including an SMS-enabled phone number associated with the user and a vehicle identification number (VIN) associated with a registered vehicle operated by the user, and receiving, at a mobile communication device, a first instruction to obtain vehicle condition information associated with the registered vehicle. The operations may further comprise determining a first geolocation of the mobile communication device and, in response to the first instruction, directing the user of the mobile communication device to a specified diagnostic service provider (such as an automotive parts retailer or a repair shop) having a capability to retrieve diagnostic data including the VIN from the registered vehicle and upload the retrieved diagnostic data to a server associated with a diagnostic database for deriving vehicle condition information from retrieved diagnostic data. Directing the user may include receiving, at the mobile communication device, a geolocation of the specified diagnostic service provider in relation to the first geolocation of the mobile communication device and displaying the geolocation of the specified diagnostic service provider on the mobile communication device. The operations may further comprise receiving the vehicle condition information from the server, the vehicle condition information having been specifically derived for the registered vehicle from the diagnostic data uploaded by the specified diagnostic service provider and associated with the user based on the VIN included in the retrieved diagnostic data or otherwise input on the mobile communication device, and displaying the received vehicle condition information for the registered vehicle on the mobile communication device.

The receiving of the geolocation of the specified diagnostic service provider may include receiving geolocations of a plurality of diagnostic service providers including the specified diagnostic service provider in relation to the first geolocation of the mobile communication device. The directing may include receiving, via user input to the mobile communication device, a selection of the specified diagnostic service provider from among the plurality of diagnostic service providers. The displaying of the geolocation of the specified diagnostic service provider may be in response to the selection. The plurality of diagnostic service providers may be determined based on the respective geolocations of the diagnostic service providers being within a threshold distance or travel time from the first geolocation of the mobile communication device.

The displaying of the vehicle condition information may include displaying an indication of an urgency level associated with the vehicle condition information.

The operations may comprise, after the displaying of the received vehicle condition information, receiving a user request for past vehicle condition information associated with the user profile, and, in response to the user request, displaying the vehicle condition information on the mobile communication device. The operations may comprise, in response to the user request, accessing the user profile to retrieve the vehicle condition information, the vehicle condition information being stored in association with the user profile. The accessing may comprise accessing the user profile at the server. The accessing may comprise accessing the user profile on the mobile communication device.

The first instruction may be received via user input to the mobile communication device.

The operations may comprise receiving, at the mobile communication device, a second instruction to identify an auto repair service provider to repair a defect indicated by the vehicle condition information, determining a second geolocation of the mobile communication device, and, in response to the second instruction, directing the user of the mobile communication device to a specified auto repair service provider having a capability to repair the defect. The directing of the user to the specified auto repair service provider may include receiving, at the mobile communication device, a geolocation of the specified auto repair service provider in relation to the second geolocation of the mobile communication device and displaying the geolocation of the specified auto repair service provider on the mobile communication device. The receiving of the geolocation of the specified auto repair service provider may include receiving geolocations of a plurality of auto repair service providers including the specified auto repair service provider in relation to the second geolocation of the mobile communication device. The directing of the user to the specified auto repair service provider may further include receiving, via user input to the mobile communication device, a selection of the specified auto repair service provider from among the plurality of auto repair service providers. The displaying of the geolocation of the specified auto repair service provider may be in response to the selection. The operations may comprise displaying, in association with at least one of the plurality of auto repair service providers, a cost to repair the defect. The operations may comprise, after the displaying of the geolocation of the specified auto repair service provider, receiving, from the server, transaction information associated with a repair service rendered by the specified auto repair service provider in association with the registered vehicle and displaying the transaction information on the mobile communication device.

The operations may further comprise receiving, at the mobile communication device, a second instruction to identify an auto parts provider to provide auto parts for repairing a defect indicated by the vehicle condition information, determining a second geolocation of the mobile communication device, and, in response to the second instruction, directing the user of the mobile communication device to a specified auto parts provider having parts suitable to repair the defect. The directing of the user to the specified auto parts provider may include receiving, at the mobile communication device, a geolocation of the specified auto parts provider in relation to the second geolocation of the mobile communication device and displaying the geolocation of the specified auto parts provider on the mobile communication device. The receiving of the geolocation of the specified auto parts provider may include receiving geolocations of a plurality of auto parts providers including the specified auto parts provider in relation to the second geolocation of the mobile communication device. The directing of the user to the specified auto parts provider may further include receiving, via user input to the mobile communication device, a selection of the specified auto parts provider from among the plurality of auto parts providers. The displaying of the geolocation of the specified auto parts provider may be in response to the selection. The operations may comprise displaying, in association with at least one of the plurality of auto parts providers, a cost of the parts. The operations may comprise, after the displaying of the geolocation of the specified auto parts provider, receiving, from the server, transaction information associated with parts purchased from the specified auto parts provider in association with the registered vehicle and displaying the transaction information on the mobile communication device.

The operations may further comprise receiving, at the mobile communication device, a second instruction to identify a roadside assistance service provider to assist with repairing a defect indicated by the vehicle condition information, determining a second geolocation of the mobile communication device, and, in response to the second instruction, directing the user of the mobile communication device to a specified roadside assistance service provider having a capability to provide roadside assistance in relation to the defect. The directing of the user to the specified roadside assistance service provider may include receiving, at the mobile communication device, contact information of the specified roadside assistance service provider in relation to the second geolocation of the mobile communication device and displaying the contact information of the specified roadside assistance service provider on the mobile communication device. The receiving of the contact information of the specified roadside assistance service provider may include receiving contact information of a plurality of roadside assistance service providers including the specified roadside assistance service provider in relation to the second geolocation of the mobile communication device. The directing of the user to the specified roadside assistance service provider may include receiving, via user input to the mobile communication device, a selection of the specified roadside assistance service provider from among the plurality of roadside assistance service providers. The displaying of the contact information of the specified roadside assistance service provider may be in response to the selection. The operations may further comprise displaying, in association with at least one of the plurality of roadside assistance service providers, a cost to provide roadside assistance in relation to the defect. The operations may further comprise, after the displaying of the geolocation of the specified roadside assistance service provider, receiving, from the server, transaction information associated with a roadside assistance service rendered by the specified roadside assistance service provider in association with the registered vehicle and displaying the transaction information on the mobile communication device.

The vehicle condition information associated with the registered vehicle may include an estimated cost associated with repairing a defect indicated by the vehicle condition information.

The retrieved diagnostic data may include at least one selected from the group consisting of a diagnostic trouble code (DTC), vehicle sensor data, freeze frame data, and live data.

The first instruction may comprise a request for symptomatic diagnosis. The operations may further comprise receiving, via user input to the mobile communication device, information identifying at least one symptom associated with the registered vehicle, accessing vehicle identifying information of the registered vehicle, deriving symptomatic diagnostic condition information of the registered vehicle from the at least one symptom and the vehicle identifying information, and displaying the symptomatic diagnostic condition information on the mobile communication device. The deriving of the symptomatic diagnostic condition information may comprise receiving, from the server, vehicle condition information associated with the user profile corresponding to the user and deriving the symptomatic diagnostic condition information from the at least one symptom, the vehicle identifying information, and the vehicle condition information associated with the user profile. The accessing may comprise accessing the vehicle identifying information at the server. The accessing may comprise accessing the vehicle identifying information on the mobile communication device.

The operations may further comprise receiving the diagnostic data from the server.

The operations may further comprise receiving a notification on the mobile communication device that the vehicle condition information is available for review. The notification may contain a link. The displaying of the received vehicle condition information may be in response to a user interaction with the link.

The diagnostic data may be retrieved by the specified diagnostic service provider from a vehicle diagnostic port disposed on the registered vehicle.

The retrieved vehicle diagnostic data may comprise an OBD diagnostic payload retrieved by the specified diagnostic service provider from a vehicle diagnostic port disposed on the registered vehicle.

Another aspect of the embodiments of the present disclosure is a non-transitory program storage medium on which are stored instructions executable by a processor or programmable circuit of a mobile communication device to perform operations for mobile application-based vehicle diagnostics. The operations may comprise receiving, at a mobile communication device, a first instruction to obtain vehicle condition information associated with the registered vehicle, determining whether a data acquisition and transfer device (DAT) for connecting the mobile communication device to a diagnostics port of a registered vehicle is present, setting an operation mode to a first mode in response to a determination that the DAT is not present, and setting the operation mode to a second mode in response to a determination that the DAT is present. The operations may further comprise, when the operation mode is set to the first mode, determining a first geolocation of the mobile communication device and, in response to the first instruction, performing suboperations comprising directing the user of the mobile communication device to a specified diagnostic service provider in relation to the first geolocation, the specified diagnostic service provider having a capability to retrieve diagnostic data including a vehicle identification number (VIN) from the registered vehicle and upload the retrieved diagnostic data to a server associated with a diagnostic database for deriving vehicle condition information from retrieved diagnostic data, receiving, at the mobile communication device, a geolocation of the specified diagnostic service provider in relation to the first geolocation of the mobile communication device, and displaying the geolocation of the specified diagnostic service provider on the mobile communication device. The operations may further comprise, when the operation mode is set to the second mode, retrieving vehicle diagnostic data including the vehicle identification number (VIN) from the registered vehicle via the DAT in response to the first instruction and uploading, from the mobile communication device to the server, the diagnostic data retrieved via the DAT, receiving the vehicle condition information from the server, the vehicle condition information having been derived from the diagnostic data uploaded either by the specified diagnostic service provider or by the mobile communication device and associated with the user based on the VIN included in the diagnostic data, and displaying the received vehicle condition information for the registered vehicle on the mobile communication device.

When the operation mode is set to the second mode, the first instruction may be automatically generated based on data passively collected from the registered vehicle by the DAT. When the operation mode is set to the second mode, the first instruction may be automatically generated based on an urgency associated with the passively collected data. The passively collected data may include a diagnostic trouble code (DTC). When the operation mode is set to the second mode, the first instruction may be automatically generated on a periodic basis. The determining of whether the DAT is present may comprise detecting a connection between the mobile communication device and the DAT.

Another aspect of the embodiments of disclosure is a method of providing mobile application-based vehicle diagnostics. The method may comprise establishing a user profile associated with a user of the mobile communication device, the profile including an SMS-enabled phone number associated with the user and a vehicle identification number (VIN) or other vehicle identifying information (e.g. year/make/model/engine information) associated with a registered vehicle operated by the user, and receiving, at a mobile communication device, a first instruction to obtain vehicle condition information associated with the registered vehicle. The method may further comprise determining a first geolocation of the mobile communication device and, in response to the first instruction, directing the user of the mobile communication device to a specified diagnostic service provider having a capability to retrieve diagnostic data including the VIN from the registered vehicle and upload the retrieved diagnostic data to a server associated with a diagnostic database for deriving vehicle condition information from retrieved diagnostic data. Directing the user may include receiving, at the mobile communication device, a geolocation of the specified diagnostic service provider in relation to the first geolocation of the mobile communication device and displaying the geolocation of the specified diagnostic service provider on the mobile communication device. The method may further comprise receiving the vehicle condition information from the server, the vehicle condition information having been derived from the diagnostic data uploaded by the specified diagnostic service provider and associated with the user based on the VIN included in the diagnostic data, and displaying the received vehicle condition information for the registered vehicle on the mobile communication device.

Another aspect of the embodiments of the present disclosure is a method of providing mobile application-based vehicle diagnostics. The method may comprise establishing a user profile associated with a user of a mobile communication device, the profile including an SMS-enabled phone number associated with the user and a vehicle identification number (VIN) associated with a registered vehicle operated by the user, and enabling the mobile communication device to receive a first instruction to obtain vehicle condition information associated with the registered vehicle. The method may further comprise enabling the mobile communication device to determine a first geolocation of the mobile communication device and enabling the mobile communication device to, in response to the first instruction, direct the user of the mobile communication device to a specified diagnostic service provider having a capability to retrieve diagnostic data including the VIN from the registered vehicle and upload the retrieved diagnostic data to a server associated with a diagnostic database for deriving vehicle condition information from retrieved diagnostic data. The directing may include receiving, at the mobile communication device, a geolocation of the specified diagnostic service provider in relation to the first geolocation of the mobile communication device and displaying the geolocation of the specified diagnostic service provider on the mobile communication device. The method may further comprise enabling the mobile communication device to receive the vehicle condition information from the server, the vehicle condition information having been derived from the diagnostic data uploaded by the specified diagnostic service provider and associated with the user based on the VIN included in the diagnostic data, and enabling the mobile communication device to display the received vehicle condition information for the registered vehicle on the mobile communication device.

Another aspect of the embodiments of the present disclosure is a system for providing mobile application-based vehicle diagnostics. The system may comprise a mobile communication device having an installed mobile application, the mobile application operable to receive a first instruction to obtain vehicle condition information associated with a registered vehicle, determine a first geolocation of the mobile communication device, receive a geolocation of a specified diagnostic service provider in relation to the first geolocation of the mobile communication device in response to the first instruction, and display the geolocation of the specified diagnostic service provider on the mobile communication device. The system may further comprise at least one server in communication with the mobile communication device, the at least one server operable to establish a user profile associated with a user of the mobile communication device and including a vehicle identification number (VIN) associated with the registered vehicle, receive diagnostic data retrieved by the specified diagnostic service provider from the registered vehicle, detect a VIN within the diagnostic data, derive vehicle condition information from the received diagnostic data, associate the vehicle condition information with the user profile by matching a VIN included in the received diagnostic data with the VIN included in the user profile, and provide the vehicle condition information to the mobile application. The mobile application may display the vehicle condition information on the mobile communication device.

The mobile application may determine a second geolocation of the mobile communication device (e.g. at the location of the specified diagnostic service provider or at the user's home), and the at least one server may provide the mobile communication device with a geolocation of one or more auto repair service providers in relation to the second geolocation of the mobile communication device, the specified (selected) auto repair service provider having a capability to repair a defect indicated by the vehicle condition information. The at least one server may provide the vehicle condition information to the specified auto repair service provider.

The mobile application may determine a second geolocation of the mobile communication device, and the at least one server may provide the mobile communication device with a geolocation of a specified auto parts provider in relation to the second geolocation of the mobile communication device, the specified auto parts provider having a part suitable to repair a defect indicated by the vehicle condition information. The at least one server may provide the vehicle condition information to the specified auto parts provider.

The mobile application may determine a second geolocation of the mobile communication device, and the at least one server may provide the mobile communication device with contact information of a specified roadside assistance service provider in relation to the second geolocation of the mobile communication device, the specified roadside assistance service provider having a capability to provide roadside assistance in relation to a defect indicated by the vehicle condition information. The at least one server may provide the vehicle condition information to the specified roadside assistance service provider.

The at least one server may store the vehicle condition information in the user profile. The mobile application may be operable to receive a user request for the vehicle condition information stored in the user profile and, in response to the user request, retrieve the vehicle condition stored in the user profile and display the retrieved vehicle condition information on the mobile communication device The first instruction may be automatically generated based on an urgency level associated with information included in the user profile.

Another aspect of the embodiments of the present disclosure is a system for providing mobile application-based vehicle diagnostics. The system may comprise a mobile communication device having an installed mobile application, the mobile application operable to receive a first instruction to obtain vehicle condition information associated with a registered vehicle, determine a first geolocation of the mobile communication device, receive a geolocation of a specified diagnostic service provider in relation to the first geolocation of the mobile communication device in response to the first instruction, and display the geolocation of the specified diagnostic service provider on the mobile communication device. The system may further comprise a diagnostic tool configured to be operable by the specified diagnostic service provider to retrieve diagnostic data from the registered vehicle. The system may further comprise at least one server in communication with the mobile communication device and operable by a different entity than the specified diagnostic service provider to establish a user profile associated with a user of the mobile communication device and including a vehicle identification number (VIN) associated with the registered vehicle, receive the diagnostic data from the diagnostic tool operable by the specified diagnostic service provider, detect the VIN in the diagnostic data, derive vehicle condition information from the received diagnostic data, associate the vehicle condition information with the user profile by matching the VIN included in the received diagnostic data with the VIN included in the user profile, and provide the vehicle condition information to the mobile application. The mobile application may display the vehicle condition information on the mobile communication device.

The mobile application may be operable to determine whether a data acquisition and transfer device (DAT) for connecting the mobile communication device to a diagnostics port of the registered vehicle is present. The mobile application may be operable to set an operation mode to a first mode in response to a determination that the DAT is not present and to set the operation mode to a second mode in response to a determination that the DAT is present. When the operation mode is set to the first mode, the mobile application may be operable to estimate a distance traveled by the mobile communication device based on a signal received by a GPS module of the mobile communication device. When the operation mode is set to the second mode, the mobile application may be operable to retrieve mileage data from the registered vehicle via the DAT and correct the estimated distance using the retrieved mileage data. When the operation is set to the first mode, the mobile application may estimate the distance on a necessary condition that the mobile communication device is within range of a wireless signal transmitted by the registered vehicle. The DAT may be configured to communicate with the vehicle using an ELM327 command protocol.

The mobile application may determine a second geolocation of the mobile communication device, and the at least one server may provide the mobile communication device with a geolocation of a specified auto repair service provider in relation to the second geolocation of the mobile communication device, the specified auto repair service provider having a capability to repair a defect indicated by the vehicle condition information. The at least one server may further provide an information package derived from the vehicle condition information to the specified auto repair service provider. The at least one server may receive a bid for repairing the defect from the specified auto repair service provider and provide the bid to the mobile application. The mobile application may display the bid on the mobile communication device. The server may scrub sensitive information from the vehicle condition information to derive the information package. The at least one server may provide the mobile communication device with contact information of the specified auto repair service provider. The mobile application may be operable to initiate a phone call from the mobile communication device to the specified auto repair service provider using the contact information.

The mobile application may determine a second geolocation of the mobile communication device, and the at least one server may provide the mobile communication device with a geolocation of a specified auto parts provider in relation to the second geolocation of the mobile communication device, the specified auto parts provider having a part suitable to repair a defect indicated by the vehicle condition information. The at least one server may further provide an information package derived from the vehicle condition information to the specified auto parts provider. The at least one server may receive a bid for the part suitable to repair the defect from the specified auto parts provider and provide the bid to the mobile application. The mobile application may display the bid on the mobile communication device. The server may scrub sensitive information from the vehicle condition information to derive the information package. The at least one server may provide the mobile communication device with contact information of the specified auto parts provider. The mobile application may be operable to initiate a phone call from the mobile communication device to the specified auto parts provider using the contact information.

The mobile application may determine a second geolocation of the mobile communication device, and the at least one server may provide the mobile communication device with contact information of a specified roadside assistance service provider in relation to the second geolocation of the mobile communication device, the specified roadside assistance service provider having a capability to provide roadside assistance in relation to a defect indicated by the vehicle condition information. The at least one server may further provide an information package derived from the vehicle condition information to the specified roadside assistance service provider. The at least one server may receive a bid for providing roadside assistance in relation to the defect from the specified roadside assistance service provider and provide the bid to the mobile application. The mobile application may display the bid on the mobile communication device. The server may scrub sensitive information from the vehicle condition information to derive the information package. The at least one server may provide the mobile communication device with contact information of the specified roadside assistance service provider. The mobile application may be operable to initiate a phone call from the mobile communication device to the specified roadside assistance service provider using the contact information.

The mobile application may be further operable to derive symptom data associated with the registered vehicle from an analysis of engine noise sensed by a microphone of the mobile communication device. The at least one server may be further operable to receive the symptom data from the mobile communication device and train a machine learning model using the received symptom data. The at least one server may train the machine learning model using the received symptom data and the received diagnostic data.

The mobile application may be further operable to derive symptom data associated with the registered vehicle from an analysis of engine vibration sensed by an accelerometer of the mobile communication device. The at least one server may be further operable to receive the symptom data from the mobile communication device and train a machine learning model using the received symptom data. The at least one server may train the machine learning model using the received symptom data and the received diagnostic data.

The mobile application may be further operable to receive a second instruction to obtain tire tread condition information and, in response to the second instruction, upload to the at least one server one or more images of a tire of the registered vehicle captured by a camera of the mobile communication device. The at least one server may be operable to derive tire tread condition information from the one or more images and provide the tire tread condition information to the mobile application. In response to the second instruction, the mobile application may display guidance on the mobile communication device for capturing the one or more images using the camera of the mobile communication device. The guidance may include feedback to the mobile application based on detected objects within a view of the camera. The tire tread condition information derived by the at least one server may comprise an assessment of one or more items selected from the group consisting of alignment, steering, suspension, tire condition, and tire rotation. The tire tread condition information derived by the at least one server may comprise a comparison of at least one feature of the one or more images to modelled tire degradation based on a manufacturer-recommended mileage life of the tire. The comparison may include a prediction of when the tire will need to be replaced. The mobile application may determine a second geolocation of the mobile communication device, and the at least one server may provide the mobile communication device with a geolocation of a specified third party provider in relation to the second geolocation of the mobile communication device, the specified third party provider having a capability to repair a defect indicated by the tire tread condition information and/or to replace a tire having a defect indicated by the tire tread condition information.

The mobile application may be further operable to derive tire pressure data associated with the registered vehicle from an analysis of at least one tire pressure signal received by the mobile communication device. The at least one tire pressure signal may comprise a plurality of signals from a plurality of tire pressure sensors disposed in respective tires of the registered vehicle. The mobile application may interface with a signal receiver, external to the mobile communication device, that receives a plurality of signals from a plurality of tire pressure sensors disposed in respective tires of the registered vehicle.

The at least one server may be further operable to push a location-specific offer from a database of offers to the mobile application based on the first geolocation of the mobile communication device. The server may select the location-specific offer based on a relevance determined according to information in the user profile associated with the user of the mobile communication device.

The mobile application may include at least one gamification feature selected from the group consisting of achievements, progress bars, badges, points, and rewards.

The diagnostic tool may be further operable to generate a barcode encoding the retrieved diagnostic data. The mobile application may be further operable to decode the diagnostic data based on an image of the barcode captured by a camera of the mobile communication device. The barcode may be a two-dimensional barcode (e.g., a QR code).

The system may further comprise a kiosk configured to be operable by an auto parts provider to retrieve additional diagnostic data from the registered vehicle. The at least one server may be further operable to receive the additional diagnostic data from the kiosk, detect the VIN in the additional diagnostic data, derive additional vehicle condition information from the additional diagnostic data, and associate the additional vehicle condition information with the user profile by matching the VIN included in the additional diagnostic data with the VIN included in the user profile. The kiosk may be operable to generate a barcode encoding the additional diagnostic data. The mobile application may be further operable to decode the additional diagnostic data based on an image of the barcode captured by a camera of the mobile communication device. The barcode may be a two-dimensional barcode (e.g., a QR code).

Another aspect of the embodiments of the present disclosure is a method of providing mobile application-based vehicle diagnostics. The method may comprise establishing a user profile associated with a user of a mobile communication device and including a vehicle identification number (VIN) associated with a registered vehicle, receiving, from the mobile communication device, a first geolocation of the mobile communication device, providing, to a mobile application installed on the mobile communication device, a geolocation of a specified diagnostic service provider in relation to the first geolocation of the mobile communication device, receiving diagnostic data of the registered vehicle from a diagnostic tool operable by the specified diagnostic service provider, detecting the VIN in the diagnostic data, deriving vehicle condition information from the received diagnostic data, associating the vehicle condition information with the user profile by matching the VIN included in the received diagnostic data with the VIN included in the user profile, and providing the vehicle condition information to the mobile application.

Another aspect of the embodiments of the present disclosure is a non-transitory program storage medium on which are stored instructions executable by a processor or programmable circuit of at least one server to perform operations for providing mobile application-based vehicle diagnostics. The operations may comprise establishing a user profile associated with a user of a mobile communication device and including a vehicle identification number (VIN) associated with a registered vehicle, receiving, from the mobile communication device, a first geolocation of the mobile communication device, providing, to a mobile application installed on the mobile communication device, a geolocation of a specified diagnostic service provider in relation to the first geolocation of the mobile communication device, receiving diagnostic data of the registered vehicle from a diagnostic tool operable by the specified diagnostic service provider, detecting the VIN in the diagnostic data, deriving vehicle condition information from the received diagnostic data, associating the vehicle condition information with the user profile by matching the VIN included in the received diagnostic data with the VIN included in the user profile, and providing the vehicle condition information to the mobile application.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present disclosure encompasses various embodiments of systems and methods for mobile application-based vehicle diagnostics. The detailed description set forth below in connection with the appended drawings is intended as a description of several currently contemplated embodiments and is not intended to represent the only form in which the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Figure 1:
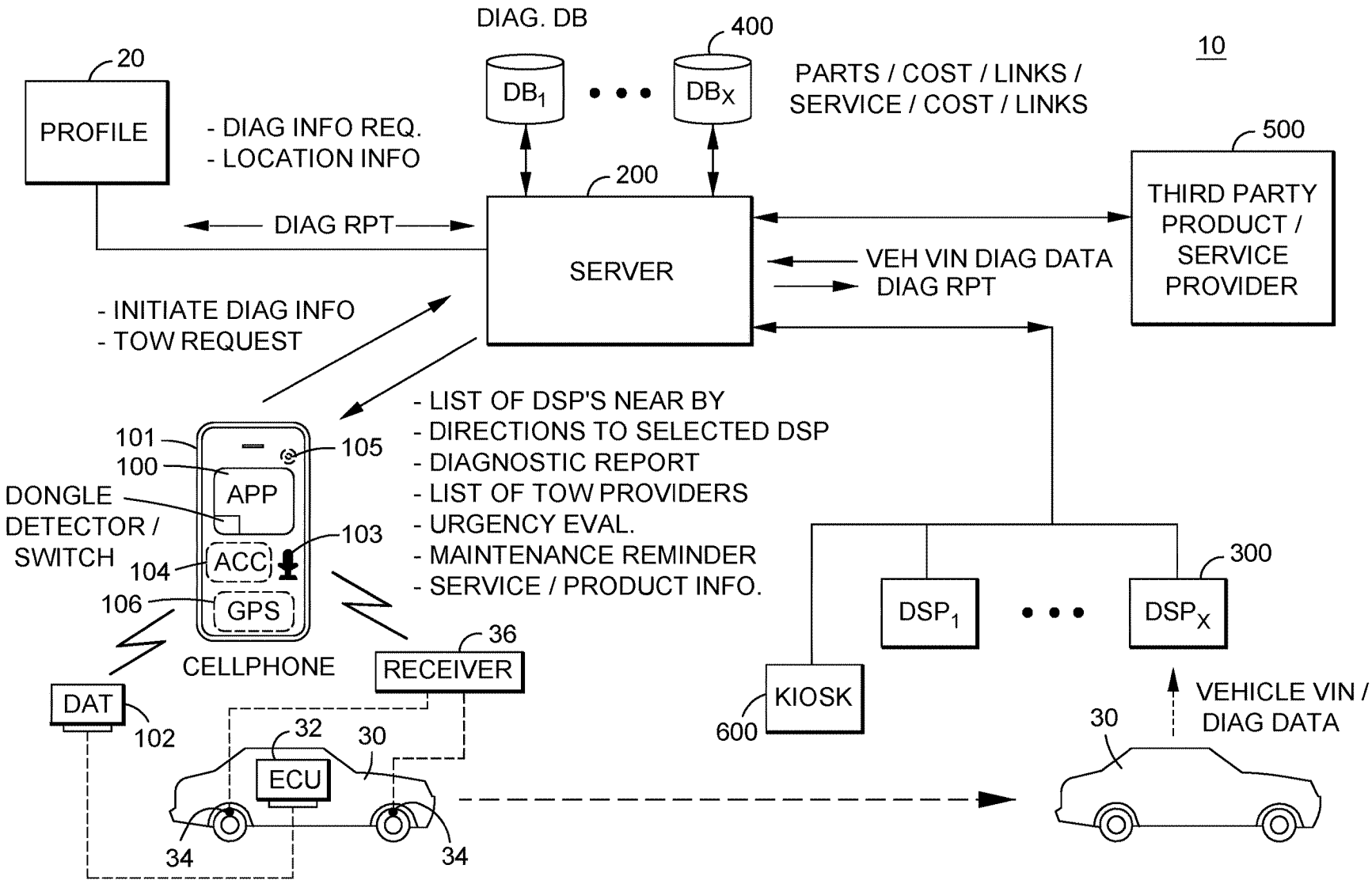
FIG. 1 shows a system for selective vehicle data retrieval according to an embodiment of the present disclosure.

FIG. 1 shows an exemplary system 10 for selective vehicle data retrieval according to an embodiment of the present disclosure. A vehicle owner may install a mobile application ("app") 100 on his or her smartphone or other mobile communication device 101 and establish a user profile 20 including a vehicle identification number (VIN) associated with the vehicle owner's vehicle 30. The app 100 may serve as the vehicle owner's gateway for all automotive needs, whether the vehicle owner wishes to diagnose the vehicle 30 (e.g. either to address some symptom or as a precaution before a road trip, for example), service the vehicle 30, review and transact with past vehicle condition information and service reports, or get immediate assistance (such as when the vehicle 30 breaks down). To this end, a server 200 in communication with the mobile communication device 101 may receive various requests from the app 100 and respond by providing targeted assistance, recommendations, and other information to the app 100 to meet the vehicle owner's particular need.

In order to provide such information targeted to the particular vehicle 30 and vehicle owner, the server 200 may manage the vehicle owner's user profile 20, which may be stored in a database of user profiles 20 for many different users of the system 10, for example. Each time the vehicle 30 is scanned for diagnostic data, whether it is done by the vehicle owner's own data acquisition and transfer device (DAT) 102 or by a scan tool belonging to a third-party diagnostic service provider 300 ($DSP_1, \ldots, DSP_X$), the retrieved diagnostic data may be uploaded to the server 200 for diagnostic analysis using one or more diagnostic databases 400 ($DB_1, \ldots, DB_X$). A diagnosis, defect, most likely fix, or other vehicle condition information may thus be returned to the vehicle owner or the third-party diagnostic service provider 300. However, unlike in the case of conventional diagnostic systems, the VIN included in the uploaded diagnostic data may further be used to associate the event with the user profile 20 that includes the same VIN. In this way, the server 200 may leverage the conventional processes of existing diagnostic service providers to accumulate individualized information in each user profile 20, irrespective of where or by what means the vehicle 30 was diagnosed.

The individualized information stored in the user profile 20 may include the vehicle condition information that has been derived based on diagnostic data retrieved from the vehicle 20. Thus, even where a third-party diagnostic service provider 300 has performed the diagnostic scan, one who may be a completely different business entity than the provider of the app 100, the vehicle owner may have full access to the resulting vehicle condition information (and the underlying diagnostic data itself) via the app 100, just as if the vehicle owner had performed the scan himself or herself. Such vehicle condition information derived from a most recent scan or from a past scan in relation to the vehicle 30 may be made available to the user via the app 100 on the screen of the mobile communication device 101, either automatically or on demand.

Upon reviewing vehicle condition information that indicates some defect in the vehicle 30, the vehicle owner may further use the app 100 to request individualized recommendations for appropriate service, parts, or roadside assistance. In this regard, the app 100 may suggest one or more third party repair service providers, auto parts providers, and/or roadside assistance providers (collectively third-party providers 500) based on the vehicle condition information and on the particular vehicle 30 as well as on current location data associated with the mobile communication device 101 or the vehicle 30. Because the app 100 has access to the user profile 20 (e.g. via the server 200), which may contain historical data associated with the vehicle 30 including vehicle owner preferences, the third-party providers 500 may in some cases be selected or ranked in an individualized manner not just for the particular defect and year/make/mode/trim but for the exact vehicle 30 in question and its owner. For example, the app 100 might prioritize third-party providers 500 that the vehicle owner has gone to (and has had positive experiences with) in the past. The app 100 may present a list of third-party providers 500 to the user, from which the vehicle owner may make a selection (e.g. based on cost, distance, etc.). The app 100 may then direct the vehicle owner to the selected third-party provider 500 (or provide contact information in the case of a roadside assistance provider) so that the vehicle owner can get the needed service, parts or roadside assistance.

Figure 2:
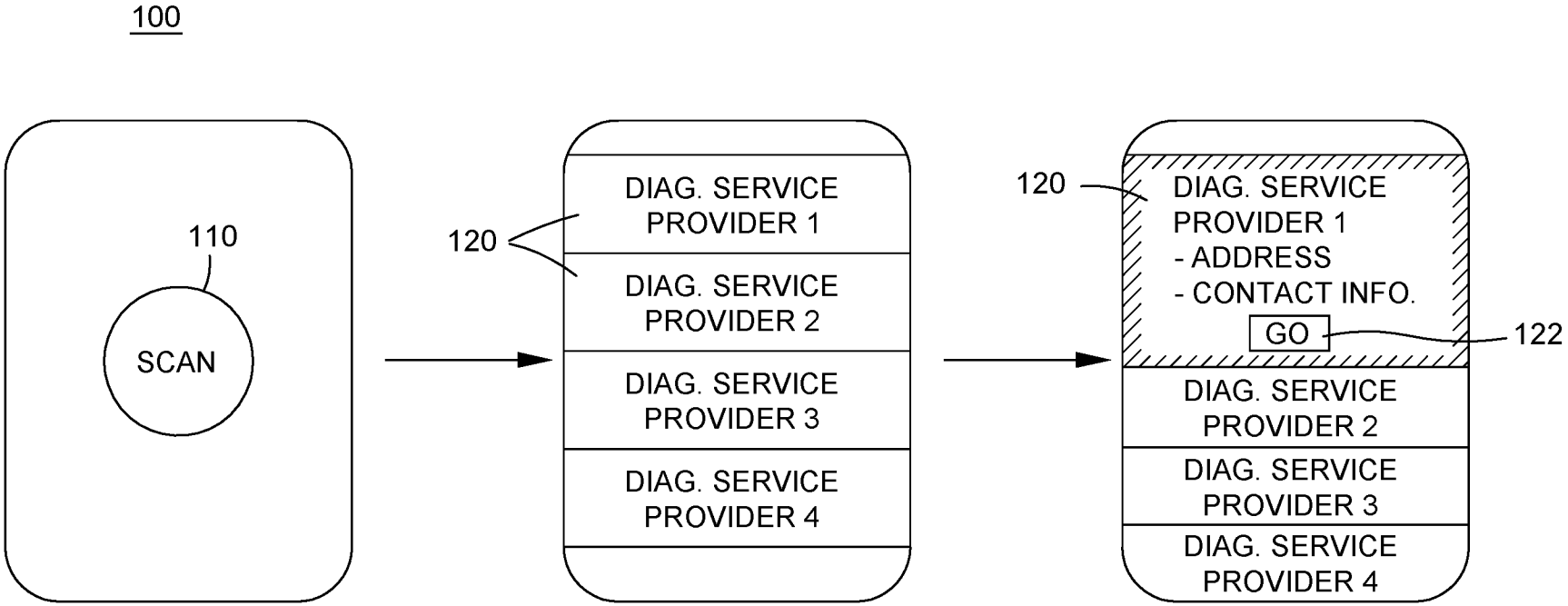
FIG. 2 shows a sequence of screenshots of a mobile application according to an embodiment of the present disclosure in relation to obtaining vehicle condition information.

FIG. 2 shows a sequence of screenshots of the app 100 in relation to obtaining vehicle condition information using the system 10. In the first (leftmost) view, the app 100 displays a scan button 110. As an example, consider a vehicle owner who is far from home, driving across country on a road trip. The vehicle owner begins to notice a recurring, unfamiliar sound coming from the engine (or, as another example, the check engine light becomes illuminated). Since the vehicle owner will soon be entering less populated areas where service options are fewer and farther between, the vehicle owner decides it would be wise to get the issue checked out sooner rather than later. The vehicle owner does not own a dongle or other DAT or scan tool but has the app 100 installed on his or her smartphone. Pulling over for a moment, the vehicle owner opens up the app 100 and taps the scan button 110.

In response to the vehicle owner's interaction with the scan button 110, the app 100 transitions to the second (center) view of FIG. 2, displaying a list of items 120, each one corresponding to a nearby diagnostic service provider 300 (see FIG. 1). Since the app 100 has already determined a geolocation of the vehicle owner's smartphone (either before or after the scan button 110 was tapped), the listed items 120 may represent those diagnostic service providers 300 that are nearby, e.g. those having a geolocation within a threshold distance of the geolocation of the smartphone or within a threshold travel time of the geolocation of the smartphone. Since the system 10 is also aware of the vehicle owner's particular vehicle 30 and the vehicle owner's personal preferences/history (as may all be included in the vehicle owner's user profile 20), it can be ensured that the listed diagnostic service providers 300 are all viable/preferred diagnostic service providers 300 for scanning the vehicle 30.

The vehicle owner reviews his or her options and taps the item 120 corresponding to his or her choice of diagnostic service provider 300, causing the app 100 to transition to the third (rightmost) view of FIG. 2, where additional details of the selected diagnostic service provider 300 may be displayed in an expanded version of the item 120. In the illustrated example, the expanded view shows address and contact information for the selected diagnostic service provider 300, whereas the collapsed view only showed the name of each diagnostic service provider 300 (though the list itself may provide information by ranking the diagnostic service providers 300 by distance, travel time, or other criteria, for example). With such an implementation, it is contemplated that the vehicle owner may need more information to make a decision and might expand and collapse several of the list items 120 before arriving at a decision. In general, the particular details that are displayed in the expanded and collapsed views may vary from implementation to implementation (or according to user preference settings), and in some cases there may be only a single view that includes all of the details for each list item 120 (possibly with links to external websites associated with each diagnostic service provider 300 if more information is needed). A button 122 may be provided in association with each item 120 (shown in FIG. 2 in the expanded/detail view only), which may initiate a navigation routine (e.g. via third-party application) to direct the vehicle owner from the current geolocation of the smartphone to the geolocation of the selected diagnostic service provider 300.

The vehicle owner is now on his or her way to a nearby diagnostic service provider 300, such as a service center, parts store, drive-up kiosk (e.g. at a gas station or other vehicle service center or an auto parts store), or anywhere else that may have a scan tool or other means of connecting to the diagnostic port of the vehicle 30 and running a scan. The vehicle owner is happy to have been able to find a suitable diagnostic service provider 300 in a totally unfamiliar area, especially one that has been selected in accordance with the vehicle owner's own vehicle 30 and preferences. It should be noted that, in some cases, the diagnostic service provider 300 may be an individual owner of a scan tool who comes to the vehicle owner and performs the scan wherever the vehicle owner is located. In such a case, the button 122 associated with that particular diagnostic service provider 300 may instead initiate a call (e.g. via the smartphone's native calling functionality) or book an appointment (e.g. via a third-party app or weblink) with the diagnostic service provider 300, rather than giving directions.

Continuing with the above example, the vehicle owner has now had the scan done, which may typically and preferably be free of charge. In particular, using a scan tool or other means, the diagnostic service provider 300 has retrieved diagnostic data from the vehicle 30, which may include diagnostic trouble codes (DTC), vehicle sensor data, freeze frame data, and live data, for example, in addition to the VIN of the vehicle 30. The diagnostic service provider 300 uploads the retrieved diagnostic data to the server 200, and the server 200 derives vehicle condition information from the uploaded diagnostic data by comparing the uploaded diagnostic data with data stored in the diagnostic database(s) 400. Exemplary diagnostic methods, including the use of such diagnostic data to arrive at a most likely root cause and repair solution, are described in the following U.S. patents and patent application publications, each of which is owned by Innova Electronics Corporation of Irvine, Calif. ("Innova"): U.S. Pat. No. 6,807,469, entitled AUTO DIAGNOSTIC METHOD AND DEVICE, U.S. Pat. No. 6,925,368, entitled AUTO DIAGNOSTIC METHOD AND DEVICE, U.S. Pat. No. 7,620,484, entitled AUTOMOTIVE MOBILE DIAGNOSTICS, U.S. Pat. No. 8,068,951, entitled VEHICLE DIAGNOSTIC SYSTEM, U.S. Pat. No. 8,019,503, entitled AUTOMOTIVE DIAGNOSTIC AND REMEDIAL PROCESS, U.S. Pat. No. 8,370,018, entitled AUTOMOTIVE DIAGNOSTIC PROCESS, U.S. Pat. No. 8,909,416, entitled HANDHELD SCAN TOOL WITH FIXED SOLUTION CAPABILITY, U.S. Pat. No. 9,026,400, entitled DIAGNOSTIC PROCESS FOR HOME ELECTRONIC DEVICES, U.S. Pat. No. 9,177,428, entitled PREDICTIVE DIAGNOSTIC METHOD, U.S. Pat. No. 9,646,432, entitled HAND HELD DATA RETRIEVAL DEVICE WITH FIXED SOLUTION CAPABILITY, U.S. Pat. No. 9,824,507, entitled MOBILE DEVICE BASED VEHICLE DIAGNOSTIC SYSTEM, U.S. Pat. No. 10,643,403, entitled PREDICTIVE DIAGNOSTIC METHOD AND SYSTEM, U.S. Patent Application Pub. No. 2013/0297143, entitled METHOD OF PROCESSING VEHICLE DIAGNOSTIC DATA, U.S. Patent Application Pub. No. 2019/0304208, entitled SYSTEM AND METHOD FOR PROACTIVE VEHICLE DIAGNOSIS AND OPERATIONAL ALERT, and U.S. Patent Application Pub. No. 2019/0304213, entitled SYSTEM AND METHOD FOR PROACTIVE VEHICLE DIAGNOSIS AND OPERATIONAL ALERT, the entire contents of each of which is expressly incorporated herein by reference. It is also contemplated that the scan tool or other diagnostic tool used by the diagnostic service provider 300 may be operable to generate a barcode such as a two-dimensional barcode (e.g., a QR code) encoding the retrieved diagnostic data. In this case, the mobile application 100 may be operable to decode the diagnostic data based on an image of the barcode captured by a camera of the mobile communication device 101. By the same token, the diagnostic service provider 300 may use such a barcode to transfer diagnostic data from one device to another (e.g., from a kiosk screen to a tablet or other point of sale device) as part of the diagnostic process and/or to auto-populate a digital shopping cart with relevant auto parts and service items. Examples of such functionality are described in Innova's U.S. patent application Ser. No. 17/573,205, filed Jan. 11, 2022, and U.S. patent application Ser. No. 17/666,115, filed Feb. 7, 2022, both entitled DIAGNOSTIC TOOL WITH QR CODE GENERATING CAPABILITY, the entire contents of each of which is expressly incorporated herein by reference.

Figure 3:
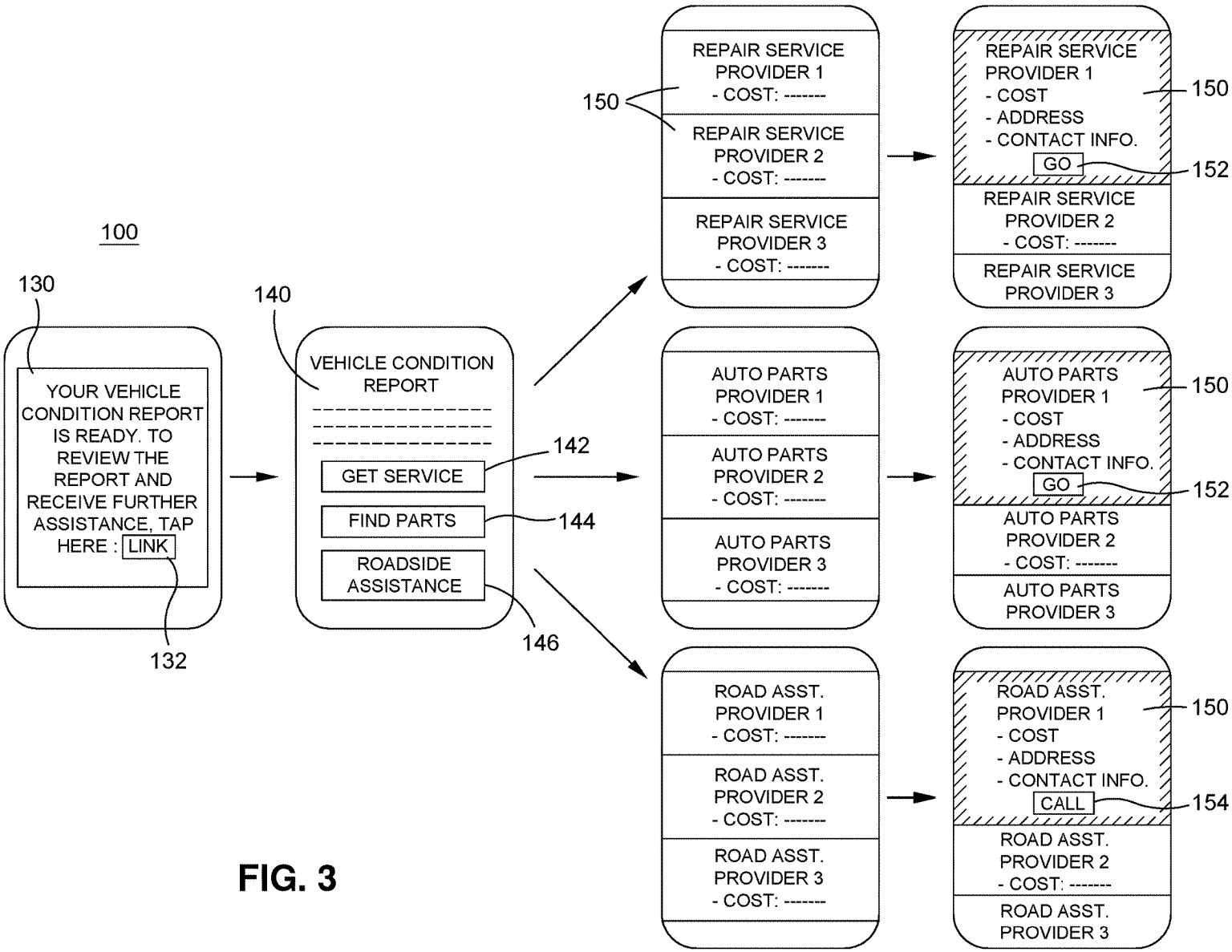
FIG. 3 shows a sequence of screenshots of the mobile application in relation to viewing vehicle condition information and requesting further assistance.

FIG. 3 shows a sequence of screenshots of the app 100 in relation to viewing vehicle condition information and requesting further assistance. Having been derived by the server 200 as described above, the vehicle condition information may be provided to the diagnostic service provider 300 according to typical diagnostic service process flows, where the diagnostic service provider 300 may use the vehicle condition information to inform the vehicle owner of a defect and/or recommend services. However, according to the exemplary system 10, the same vehicle condition information may also be provided to the vehicle owner via the app 100 in a parallel process that places the vehicle owner directly in control of the information. In the first (leftmost) view of FIG. 3, a notification 130 has been received on the vehicle owner's smartphone, which may be presented within the app 100, as a native notification of the smartphone operating system (e.g. a lock screen notification), or as a text message (e.g. SMS), for example. In the illustrated example, the notification 130 says, "Your vehicle condition report is ready. To review the report and receive further assistance, tap here:" followed by a link 132. Continuing with our example from above, the vehicle owner on the road trip may have just completed the scan at the diagnostic service provider 300 selected using the app 100 (see FIG. 2). Moments later, while he or she is still at the location of the diagnostic service provider 300 (though not necessarily so), the vehicle owner receives the notification 130 and taps the link 132.

In response to the vehicle owner's interaction with the link 132, the app 100 may display the received vehicle condition information on the vehicle owner's smartphone in the form of a vehicle condition report 140 as shown in the second (center-left) view of FIG. 3. In a case where the notification 130 is presented on the smartphone outside the app 100, the link 132 may deep link directly to the vehicle condition report 140 within the app 100. The vehicle condition information displayed in the vehicle condition report 140 may include, for example, the retrieved vehicle data, including the VIN, digital trouble codes, freeze frame data, live data, and other sensor data and identification of a most likely defect and an associated diagnostic solution derived from the diagnostic data that was retrieved from the vehicle 30. In some cases, the report may also include an estimated cost to repair the defect, along with the underlying diagnostic data itself. In reviewing the vehicle condition report 140, the vehicle owner of the above example learns that the engine's head gasket is the likely cause of the engine noise and should therefore be replaced. To assist the vehicle owner in dealing with this or any other issue indicated by the vehicle condition information, the app 100 may present to the user one or more buttons 142, 144, 146 in association with the vehicle condition report 140. Continuing with the example of the bad head gasket, the vehicle owner decides to seek a repair service to replace the head gasket and thus fix the defect. Therefore, the vehicle owner taps the "get service" button 142.

In response to the vehicle owner's interaction with the "get service" button 142, the app 100 transitions to the third (center-right) view of FIG. 3, following the uppermost of the three arrows from the second (center-left) view. The app 100 displays a list of items 150 similar to the items 120 of FIG. 2, only in this case each item 150 to a nearby repair service provider 500 (see FIG. 1) rather than a diagnostic service provider 300. From here, the vehicle owner selects between the listed repair service providers 500, possibly expanding one or more of the list items 150 for additional details as shown in the fourth (rightmost) view of FIG. 3. Unlike the diagnostic service described above, the repair service typically has a cost associated with it, so it is contemplated that each list item 150 may include a display of the cost to repair the defect, which may vary from service provider to service provider. When the vehicle owner has made his or her decision, he or she may tap the button 152 ("GO") to be directed to the selected repair service provider 500 in the same way as described above in the case of the diagnostic service provider 300. It is noted that the app 100 will use the new current geolocation of the smartphone or vehicle 30, both for compiling the list of repair service providers 500 and for directing the vehicle owner to the selected repair service provider 500, as the geolocation will often be different from what it was at the time of the vehicle owner's original instruction to initiate the scan. Because the app 100 compiles the list of repair service providers 500 according to the vehicle condition information, the particular vehicle 30, and any vehicle owner preferences, all of which may be known from the vehicle condition information and the user profile 20, the vehicle owner has the reassurance that the repair service provider 500 he or she selected is capable of fixing the defect at hand. The vehicle owner may confidently rely on the repair service provider 500 to resolve the issue (and get back to the road trip), even when in an unfamiliar area.

If the vehicle owner had been interested in replacing the head gasket by himself or herself, or wants to compare the cost of parts from different sources, the vehicle owner may have instead tapped the "find parts" button 144, in response to which the app 100 would have equivalently displayed a list of items 150 corresponding to nearby auto parts providers 500. Each auto parts provider 500 listed by the app 100 would have already been determined to have the needed part based on the vehicle condition report 140 and the particular vehicle 30. Likewise, if the vehicle owner had decided that a tow was preferable, the vehicle owner may have instead tapped the "roadside assistance" button 146. In this case, the app 100 would have displayed a list of nearby roadside assistance providers 500 capable of providing roadside assistance in relation to the particular defect indicated by the vehicle condition report 140 (and for the particular vehicle 30). In some cases, the vehicle condition information included in the vehicle condition report 140 may include an urgency level associated with the vehicle condition information for a specific vehicle. The urgency level may be displayed to the user to assist the user in choosing how, when, and where to repair the defect and, for example, whether to request roadside assistance 146. It is contemplated that the urgency level may indicate, for example, whether the vehicle 30 should be driven in its current state, such that the app 100 may advise the vehicle owner to request roadside assistance using the "roadside assistance" button 146 rather than finding and driving to a repair service provider 500 using the "get service" button 142. Conversely, for non-urgent defects, the vehicle condition report 140 may recommend that a DIYer simply order the needed part using the "find parts" button 144, rather than driving to an auto parts store.

Figure 4:
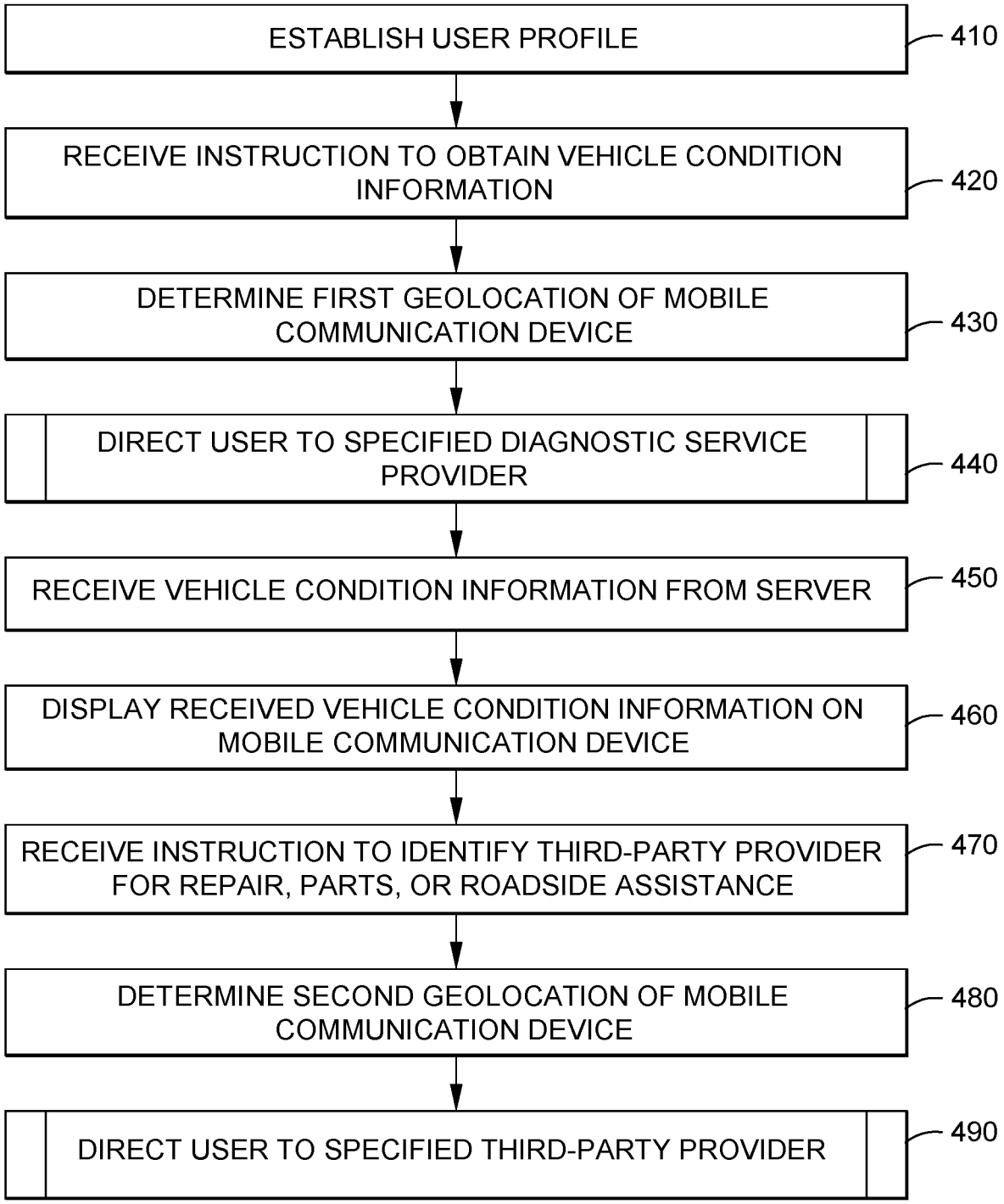
FIG. 4 shows an example operational flow according to an embodiment of the present disclosure.
Figure 5:
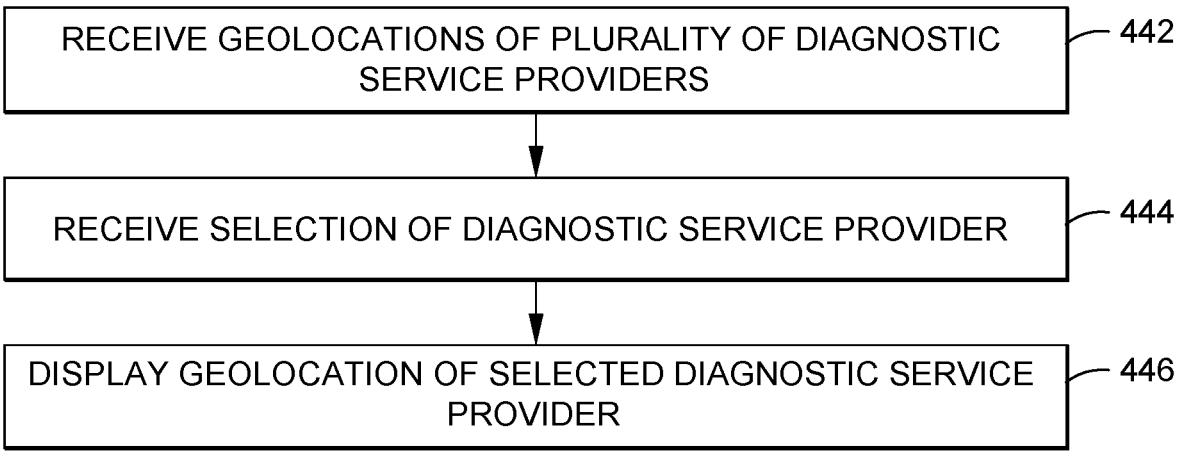
FIG. 5 shows an example sub-operational flow of step 440 in FIG. 4.
Figure 6:
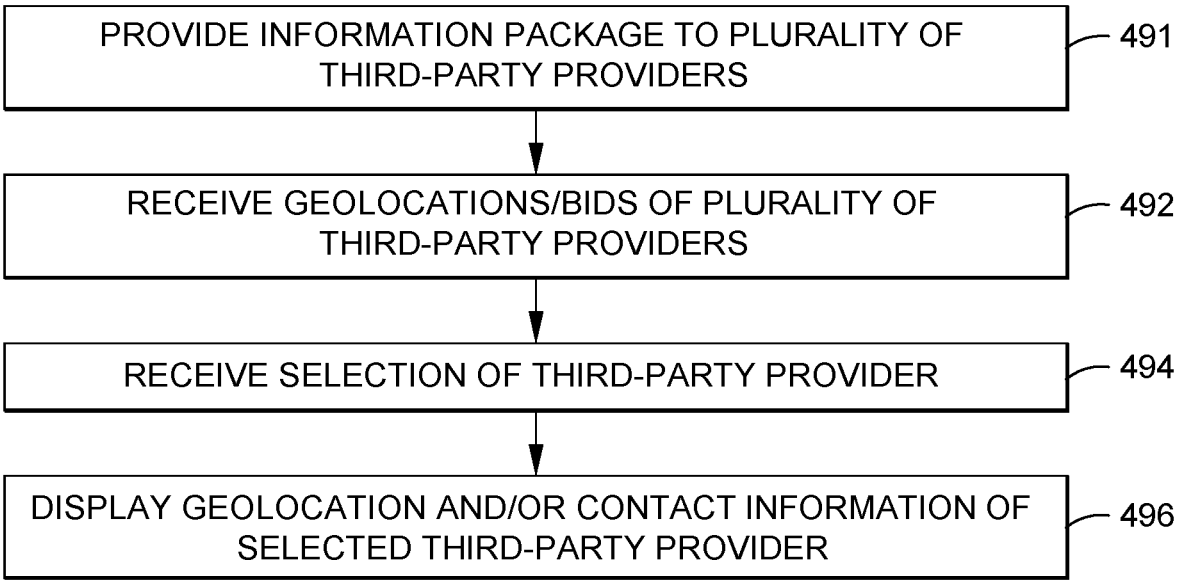
FIG. 6 shows an example sub-operational flow of step 490 in FIG. 4.

FIG. 4 shows an example operational flow according to an embodiment of the present disclosure, with FIGS. 5 and 6 showing example sub-operational flows of steps 440 and 490, respectively. The operational flow of FIGS. 4-6 may be performed, in whole or in part, by one or more elements of the system 10 shown and described in relation to FIGS. 1-3. In particular, the operational flow may be performed by the mobile application 100 installed on a smartphone or other mobile communication device 101 belonging to an owner of a vehicle 30. The operational flow may begin with establishing a user profile associated with a user of the mobile communication device 101, namely the vehicle owner (step 410). The app 100 may establish the user profile, for example, by prompting a new user to input certain information such as personal and vehicle identifying information (e.g. a VIN associated with a registered vehicle operated by the user), contact information such as an SMS-enabled phone number for receiving notifications, secure login credentials, etc. For the sake of convenience, the app 100 may allow the user to input the VIN by optically scanning a VIN bar code using the mobile communication device 101. Once all the information is input, the app 100 may communicate with the server 200 (see FIG. 1) to create and store a user profile 20 associated with the new user and the vehicle 30. As described above, the user profile 20 will grow over time to include data from any and all automotive diagnostic and service events associated with the vehicle 30, regardless of where or how the data is obtained. This may be achieved by virtue of the association of the user profile 20 with the VIN, which may thus be matched by the server 200 with incoming diagnostic data from disparate sources as described above.

With the user profile 20 having been established, the vehicle owner may begin to use the app 100 as described in relation to FIGS. 1-3. In particular, the operational flow of FIG. 4 may continue with receiving, at the mobile communication device 101, an instruction to obtain vehicle condition information (step 420). In the examples thus far described, the instruction is received via user input to the mobile communication device 101, such as by tapping a scan button 110 (see FIG. 2). However, the instruction may also be received remotely (e.g. by wireless communication) and/or automatically generated in response to a current state of the vehicle 30 as described in more detail below. At any time proximate to the receipt of the instruction to obtain the vehicle condition information (whether before or after), the operational flow may further include determining a first geolocation of the mobile communication device 101 (step 430), e.g., using cellular data and/or a GPS module 106 included in the mobile communication device 101. This can be done at all times (e.g. periodically) or may be in response to the instruction, for example, as long as the geolocation is determined at a point in time near enough to be reliably used by the app 100.

In response to the instruction to obtain the vehicle condition information, and based on the first geolocation, the operational flow may continue with directing the user of the mobile communication device 101 to a specified diagnostic service provider having a capability to retrieve diagnostic data (including the VIN) from the vehicle 30 and upload it to the server 300 (step 440). In this regard, as represented by the sub-operational flow of FIG. 5, the app 100 may receive geolocations of a plurality of diagnostic service providers 300 in relation to the first geolocation of the mobile communication device 101 (step 442) and display a list of nearby diagnostic service providers 300 as described in relation to FIG. 2 (e.g. those diagnostic service providers 300 having a geolocation within a threshold distance or travel time as described above). The app 100 may then receive a selection of one of the diagnostic service providers 300 via user input to the mobile communication device 101 (step 444), such as by the user expanding one of the list items 120 as shown in FIG. 2. The app 100 may then display the geolocation of the selected diagnostic service provider 300 as shown in the right-most view of FIG. 2 ("ADDRESS") (step 446), thus directing the user to the selected diagnostic service provider 300. The user may further request navigation assistance using the button 122 if desired.

Once the vehicle 30 has been scanned (e.g. by the selected diagnostic service provider 300 who may be a different business entity than the provider of the app 100) and diagnostic data has thus been retrieved and uploaded to the server 200, the operational flow of FIG. 4 may continue with receiving the derived vehicle condition information from the server 200 (step 450). In particular, as described above, the derived vehicle condition information may be provided to the app 100 on the vehicle owner's own mobile communication device 101 in addition to being provided to the diagnostic service provider 300 who conducted the scan. This may be made possible by taking advantage of the VIN included in the uploaded diagnostic data, which can be detected from the vehicle data by the server or other processor, and matched with the owner of the vehicle 30 by querying stored user profiles 20 for a matching VIN. With the vehicle condition information having been received by the app 100, the app 100 may then display the received vehicle condition information on the mobile communication device 101 (step 460). This may be in the form of the vehicle condition report 140 described above in relation to FIG. 3, for example. As also shown in FIG. 3, it should be noted that steps 450 and 460 may be preceded by the mobile communication device 101 receiving a notification 130 that the vehicle condition information is available for review, at which time the vehicle condition information itself may be at the server 200 and not yet on the mobile communication device 101. The operational flow may then proceed with steps 450 and 460, including the retrieval of the vehicle condition information from the server 200, in response to the user's interaction with the link 132.

The operational flow of FIG. 4 may continue with receiving, at the mobile communication device 101, an instruction to identify a third-party provider for repair, parts, or roadside assistance (step 470). For example, as shown in FIG. 3, the app 100 may receive the instruction via user interaction with one or more buttons 142, 144, 146 that may be displayed in association with the vehicle condition report 140 containing the vehicle condition information. Whether the vehicle owner requests service, parts, or roadside assistance, the app 100 may provide targeted assistance as desired, taking into account the vehicle condition information, the particular vehicle 30, and any preference information of the user that may be included in the user profile 20. To this end, at any time proximate to the receipt of the instruction (whether before or after), the operational flow may further include determining a second geolocation of the mobile communication device 101 (step 480), e.g., using cellular data and/or a GPS module 106 included in the mobile communication device 101. As described above in relation to step 430, the determination of the second geolocation of step 480 can be done at all times (e.g. periodically) or may be in response to the instruction (in this case, in response to the instruction for repair, parts, or roadside assistance), for example, as long as the geolocation is determined at a point in time near enough to be reliably used by the app 100.

In response to the instruction, the operational flow may continue with directing the user of the mobile communication device 101 to a specified third-party provider having a capability to repair a defect indicated by the vehicle condition information, having parts suitable to repair the defect, or having a capability to provide roadside assistance in relation to the defect (step 490). In this regard, as represented by the sub-operational flow of FIG. 6, the app 100 may receive geolocations of a plurality of third-party providers 500 in relation to the second geolocation of the mobile communication device 101 (step 492), which may be different from the first geolocation if the vehicle 30 has moved since the scan was requested. The app 100 may display a list of nearby third-party providers 500 as described in relation to FIG. 3 (e.g. those repair service providers, auto parts providers, and/or roadside assistance service providers having a geolocation within a threshold distance or travel time as described above). The app 100 may then receive a selection of one of the third-party providers 500 via user input to the mobile communication device 101 (step 494), such as by the user expanding one of the list items 150 as shown in FIG. 3. The app 100 may then display the geolocation and/or contact information of the selected third-party provider 500 as shown in the right-most view of FIG. 3 ("ADDRESS," "CONTACT INFO") (step 496), thus directing the user to the selected third-party provider 500. The user may further request navigation assistance using the button 152 or initiate a call using the button 154 as appropriate.

After the operational flow of FIG. 4, once the vehicle owner has transacted with the repair service provider, auto parts provider, or roadside assistance provider (collectively "third-party provider 500") that the app 100 helped find, it is contemplated that a record of the service or purchase may be uploaded by the third-party provider 500 to the server 200, which the server 200 may then store with the user profile 20. The vehicle owner may later want to view transaction information from the service or purchase event, for recordkeeping or possibly to share with another person or business. To this end, upon the vehicle owner's request or in response to some event or at a prearranged time (e.g. as a year-end report), the app 100 may receive, from the server 200 transaction information associated with a repair service rendered by an auto repair service provider, parts purchased by an auto parts provider, or roadside assistance service rendered by a roadside assistance service provider in association with the vehicle 30. The app 100 may display the transaction information on the mobile communication device 101 for use by the vehicle owner.

Along the same lines, it should be noted that the server 200 may continually store vehicle condition information as well as transaction information in the user profile 20. In this way, the user profile 20 may include a long and detailed record of the diagnostic and service events over the lifetime of the vehicle 30. At any time, the vehicle owner may wish to access this past event data, including previous received and viewed vehicle condition information. In this regard, sometime after the operational flow of FIG. 4, the app 100 may receive a user request for past vehicle condition information associated with the user profile 20. In response to the user request, the app 100 may display the vehicle condition information on the mobile communication device 101. For example, the app 100 may retrieve the requested vehicle condition information by accessing the user profile 20, which may be stored at the server 200 or other data storage location, or in some cases locally on the mobile communication device 101.

In some situations, a vehicle owner may experience vehicle trouble and may tap the scan button 110 but may not have time to get to a diagnostic service provider 300 to perform the scan. Or, the vehicle owner may intend to go immediately to the diagnostic service provider 300 but may still want more information, such as a rough diagnosis, in the meantime before getting the scan. To accommodate vehicle owners in these situations, the app 100 may further offer symptomatic vehicle diagnostic functionality. For example, upon tapping the scan button 110, the app 100 may, in addition to directing the user to a diagnostic service provider 300 in step 440, further allow the user to input to the mobile communication device 101 information identifying at least one symptom associated with the vehicle 30. For instance, the app may prompt the vehicle owner with a series of questions (e.g. does the car start? is there smoke coming out of the engine?) similar to troubleshooting. The app 100 may further access vehicle identifying information (e.g. the VIN) of the vehicle 30, either by taking it from the user profile 20 (e.g. accessed at the server 200 or on the mobile communication device 101) or receiving it as additional user input to the app 100. Based on the at least one symptom input by the user and the vehicle identifying information, the app 100 may derive symptomatic diagnostic condition information, which may not be as precise as the scan-based vehicle condition information but may still be of some value. The app 100 may display the symptomatic diagnostic condition information on the mobile communication device 101 to inform the vehicle owner. By accessing the user profile 20, the app 100 may further receive past vehicle condition information associated with the user profile 20 and derive the symptomatic diagnostic condition information further taking into account past vehicle condition information. In this way, a more targeted and potentially relevant symptomatic diagnosis can be derived with increased value for the vehicle owner.

As illustrated by the above examples, the disclosed system 10 makes it possible for a vehicle owner to obtain and accumulate vehicle condition information, which can be used to provide targeted recommendations and information to the vehicle owner over an app 100, even without owning a dongle or other data acquisition and transfer device (DAT) 102 for connecting the vehicle owner's mobile communication device 101 to a diagnostics port of the vehicle 30. However, it is also contemplated that many vehicle owners do own or are willing to buy a DAT 102. By owning a DAT 102, the vehicle owner can avoid visiting a diagnostic service provider 300 to do a scan as described above, since the vehicle owner may instead do his or her own scan using the DAT 102. As explained above, however, the same vehicle owner may at various times prefer to have the scan done by another or simply may not wish to use the DAT 102 (e.g. because of concern that it drains the vehicle battery). In order to offer an enhanced experience to users who have a DAT 102, while still providing individualized services to all vehicle owners, it is contemplated that the app 100 may have two operation modes depending on whether or not a DAT 102 will be used: a first mode that does not use the DAT 102 (and instead directs the user to a diagnostic service provider 300) and a second mode that uses the DAT 102.

In order to provide a seamless user experience, the app 100 may automatically determine whether a DAT 102 is present (see "dongle detector/switch" in FIG. 1). For example, when operative the app 100 may autonomously detect a connection between the mobile communication device 101 and the DAT 102 (e.g. a short-range wireless connection such as a Bluetooth connection). The operation mode of the app 100 may autonomously transition to the first mode in response to a determination that the DAT 102 is not present and to the second mode in response to a determination that the DAT 102 is present. Alternatively, the app may be set to the first mode, whereupon the app 100 may proceed as discussed above, including steps 430 and 440 of FIG. 4 in which the app 100 assists the vehicle owner with getting a scan from a diagnostic service provider 300 (possibly with symptomatic diagnosis in the meantime). On the other hand, when the operation mode is set to the second mode, the app 100 may omit steps 430 and 440 of FIG. 4 entirely. In this case, the app 100 may instead retrieve diagnostic data including the VIN directly from the vehicle 30 via the DAT 102 in response to the scan instruction received in step 420. The app 100 may then upload the retrieved diagnostic data from the mobile communication device 101 to the server 200, with steps 450 and onward proceeding as described above. It is also contemplated that the app 100 may generate a barcode encoding some or all of the retrieved diagnostic data, as described in the above-mentioned '205 and '115 applications, while the operation mode is set to the second mode. In this way, the app 100 may enable the flexible transfer of the data to another device, such as a device belonging to a third-party provider of diagnostics, auto parts, and/or repair service providers, who may then communicate with the server 200 on behalf of the vehicle owner, populate a shopping cart, etc.

When the operation mode of the app 100 is set to the second mode (i.e. DAT present), it is further contemplated that the scan instruction received in step 420 may be automatically generated rather than being based on user input (e.g. tapping the scan button 110). While the DAT 102 is present and plugged into the vehicle 30, the DAT 102 may passively collect data from the vehicle 30, such as DTCs, which may be transmitted from the DAT 102 to the mobile communication device 101. The app 100 may automatically generate the first instruction based on such passively collected data. For example, the passively collected data might have an associated urgency, which can be interpreted by the app 100. In the case of an urgent DTC or other passively collected data that is considered urgent, the app 100 may automatically generate the instruction to perform the scan, which may then automatically be performed via the DAT 102 (possibly with confirmation by the vehicle owner first: "Urgent condition detected; full scan recommended: Proceed?"). Alternatively, the first instruction may be automatically generated on a periodic basis as long as the DAT 102 is present and the operation mode of the app 100 is accordingly set to mode 2. For example, the app 100 may be set to perform a full scan using the DAT 102 once per week or according to a recommended service schedule associated with the particular vehicle 30. If, at any time, the vehicle owner wishes to forgo using the DAT 102, the app 100 may automatically switch to mode 1 and recommend nearby diagnostic service providers 300 for scanning the vehicle 30.

As explained above, the user profile 20 may, over time, become a long and detailed record of the diagnostic and service events over the lifetime of the vehicle 30. It is contemplated that this accumulated information may in some cases be passed from one user profile 20 to another as the ownership of the vehicle 30 changes, with the information remaining associated with the VIN as the VIN moves to a different user profile 20. In this way, a new owner of a vehicle 30 may still be able to access past information, which may in some cases be scrubbed to remove personal or other sensitive information of prior vehicle owners.

The functionality described above in relation to the components of the system 10 and app 100 shown in FIGS. 1-3 and the operational flow described in relation to FIGS. 4-6 and throughout the disclosure may be wholly or partly embodied in one or more computers including a processor (e.g. a CPU), a system memory (e.g. RAM), and a hard drive or other secondary storage device. The processor may execute one or more computer programs, which may be tangibly embodied along with an operating system in a computer-readable medium, e.g., the secondary storage device. The operating system and computer programs may be loaded from the secondary storage device into the system memory to be executed by the processor. The computer may further include a network interface for network communication between the computer and external devices (e.g. over the Internet), such as between the mobile communication device 101 and the server 200 or between the server 200 and computers controlled by diagnostic service providers 300, third-party providers 500, etc. To the extent that functionality may be performed at the server 200 rather than by the app 100, the server 200 may comprise multiple physical servers and other computers that communicate with each other to perform the described functionality.

The above computer programs may comprise program instructions which, when executed by the processor, cause the processor to perform operations in accordance with the various embodiments of the present disclosure. The computer programs may be provided to the secondary storage by or otherwise reside on an external computer-readable medium such as a DVD-ROM, an optical recording medium such as a CD or Blu-ray Disk, a magneto-optic recording medium such as an MO, a semiconductor memory such as an IC card, a tape medium, a mechanically encoded medium such as a punch card, etc. Other examples of computer-readable media that may store programs in relation to the disclosed embodiments include a RAM or hard disk in a server system connected to a communication network such as a dedicated network or the Internet, with the program being provided to the computer via the network. Such program storage media may, in some embodiments, be non-transitory, thus excluding transitory signals per se, such as radio waves or other electromagnetic waves. Examples of program instructions stored on a computer-readable medium may include, in addition to code executable by a processor, state information for execution by programmable circuitry such as a field-programmable gate arrays (FPGA) or programmable logic array (PLA).

In the above-described system 10 and associated methods, the use of a dongle or other data access and transfer (DAT) device 102 (see FIG. 1) may additionally allow for improved accuracy of mileage tracking functionality. Such functionality may be included in the disclosed app 100 or another mobile application installed on the user's mobile communication device 101, for example. In general, in order to determine an estimated mileage for various purposes such as expense reimbursement or tax calculation, the app 100 or another mobile app (e.g., a third-party app) may use GPS to estimate a distance traveled by the mobile communication device 101. Since the user is not always traveling in his/her vehicle 30, such functionality may, for example, first check for a known Bluetooth signal indicating that the mobile communication device 101 is within the vehicle 30. If it is determined that the mobile communication device 101 is within the vehicle 30 (i.e., within Bluetooth range), the GPS-derived distance may be logged as vehicle mileage. The disclosed system 10 and methods may improve the accuracy of such functionality by periodically correcting the GPS-based or otherwise estimated mileage. To this end, while the DAT 102 is present and plugged into the vehicle 30, the DAT may receive accurate mileage data collected from the ECU 32 of the vehicle 30, which may then be transmitted from the DAT 102 to the mobile communication device 101. The app 100 can then update the estimated mileage by, for example, replacing it with the mileage data collected from the vehicle 30. At other times, while the DAT 102 is not being used, the app 100 may presume the correctness of the GPS-based or otherwise estimated mileage until the next periodic correction. In this way, the accuracy of the mileage tracker functionality can be improved, whether such functionality resides in the app 100 itself or in a separate app that the app 100 communicates with on the mobile communication device 101.

It is noted that the dongle or other data access and transfer (DAT) device 102 that is referred to throughout the above disclosure may be a DAT 102 that is specifically adapted to interface with the app 100 or may be a DAT 102 developed by a third party unrelated to the provider of the app 100. With regard to the latter case, it is contemplated that the app 100 may have compatibility with multiple DATs 102, including backwards compatibility with legacy DATs 102. To this end, the DAT 102 may be configured to (or configurable to) communicate over the OBD port of the vehicle 30 using a plurality of protocols, for example, the ELM327 command protocol.

As described above, it is contemplated that each list item 150 displayed on the app 100 in response to the user's request (see FIG. 3), whether it be for repair services, auto parts, or roadside assistance, may include a display of the associated cost. The displayed cost may be an estimated cost as noted above, which may be derived from past cost data specific to the defect and the particular vehicle 30. Since, as explained above, the cost may vary from third-party provider to third-party provider, it is contemplated that the estimated cost may further be derived for each specific third-party provider based on past data. Alternatively, or additionally, the app 100 may display an actual bid as the cost for each list item 150. For example, in response to the user's request over the app 100, the system 10 may send an information package including information about the particular diagnostic condition and vehicle 30 to each of a plurality of third-party providers (step 491 of FIG. 6), who may then respond with individual bids for the repair, auto parts, or roadside assistance (step 492 of FIG. 6). The information package may include the same vehicle condition information that is derived from the diagnostic data and used to generate the vehicle condition report 140 for the user. In some cases, the system 10 may scrub personal or other identifying or sensitive information from the version that is sent to third-party providers to obtain a bid, with a more complete version of the vehicle condition information thereafter being provided to the third-party provider that is selected by the user (if necessary or desired).

As explained above, the diagnostic service provider 300 may in some cases be an individual owner of a scan tool who comes to the vehicle owner and performs the scan wherever the vehicle owner is located. As such, the button 122 associated with that particular diagnostic service provider 300 (see FIG. 2) may instead initiate a call (e.g. via the smartphone's native calling functionality) or book an appointment (e.g. via a third-party app or weblink) with the diagnostic service provider 300, rather than giving directions. Along the same lines, it is also contemplated that the third-party provider 500 (e.g., the repair service provider or auto parts provider) may similarly perform repair services or provide parts wherever the vehicle owner is located. Such a third-party provider 500 may be a skilled individual or an auto parts reseller, for example, who may provide peer-to-peer services as part of the so-called "share" economy. Thus, the button 152 associated with such a mobile-type third-party provider 500 (see FIG. 3) may similarly initiate a call or book an appointment with the third-party provider 500, rather than giving directions.

In the above example of the app 100 in which symptomatic vehicle diagnostic functionality is offered in addition to scan-based diagnostics, it is described that the app 100 may prompt the user to input information on the mobile communication device 101, for example, in the form of answers to a series of questions. However, the disclosure is not limited to such question-based symptomatic diagnosis. As another example, the app 100 may derive symptom data from an analysis of the noise or vibration of the engine, which may be sensed by the mobile communication device 101 using a microphone 103 and/or accelerometer 104 thereof, for example. The app 100 may further access vehicle identifying information (e.g., the VIN) of the vehicle 30, either by taking it from the user profile 20 (e.g., accessed at the server 200 or on the mobile communication device 101) or receiving it as user input to the app 100. Based on the symptom data derived by the app 100 and the vehicle identifying information (as well as in some cases past vehicle condition information associated with the user profile 20), the app 100 may derive the symptomatic diagnostic condition information, which may be displayed on the mobile communication device 101 to inform the vehicle owner as described above.

It is also contemplated that the symptom data, whether derived from sound/vibration analysis or from user input, may be used to build a machine learning database for the specific vehicle 30 and/or more broadly for the year/make/model/engine. As an example, the user may request the symptomatic diagnosis while waiting for a scan-based diagnosis as described above. In this case, the diagnostic condition information derived from the scan may represent a "correct" diagnosis of the vehicle, which can then be associated with the near-in-time symptom data that was captured by the mobile communication device 101. The association between the collected symptom data with the "correct" scan-based diagnosis may serve as training data to a machine learning model. In this way, a machine learning model may be developed that is specific to the exact vehicle 30 driven by the user (e.g., the vehicle is exhibiting the exact same noise and therefore likely has the same problem as last time). By the same token, a large quantity of data from many users may be collected to build machine learning models having broad applicability to the year/make/model/engine of the vehicle 30, thus improving the sound or vibration-based symptomatic diagnostics capability of the app 100 for all users.

Figure 7:
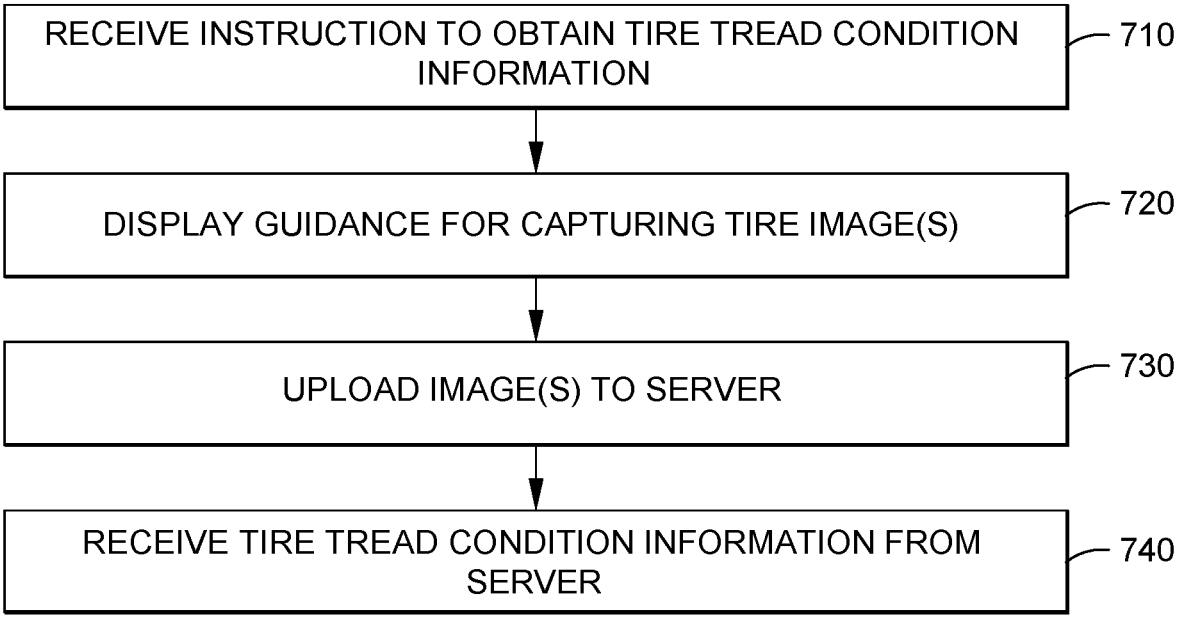
FIG. 7 shows another example operational flow according to an embodiment of the present disclosure.

Another source of information about the user's vehicle 30 that is contemplated by the present disclosure is captured image data of the vehicle's tires. Such image data may be analyzed to diagnose the condition of the vehicle's tires and, in particular, the wear of the tire treads. In this regard, FIG. 7 shows an example operational flow for tire tread diagnostics. In response to an instruction to obtain tire tread condition information received at the mobile communication device 101 (step 710), the app 100 may display guidance on the mobile communication device 101 for capturing one or more images of a tire of the vehicle 30 using a camera 105 of the mobile communication device 101 (step 720). The guidance may include, for example, written or spoken instructions describing where exactly to point the camera 105 for the most accurate analysis. The user may be directed to move vehicle point to vehicle point capturing tread, e.g., from the front-left of the tire to the front-right, etc. In this way, diagnostics can be assessed from various points of the vehicle 10. The guidance may include displaying one or more image capture templates on the screen of the mobile communication device 101 superimposed on the camera view. The image capture template(s) may, for example, show an outline of a typical tire and a portion of a vehicle for context, and the user may line up the outline with the actual tire of the vehicle to achieve the correct orientation and optimal distance for capturing the image(s). The guidance may include feedback to the app 100 based on detected objects within the camera view, such as an instruction to "back up" or "move closer." In some cases, the feedback may be in the form of a command issued to the mobile communication device 101 by the app 100 to automatically capture the image when the camera 105 is correctly lined up with the tire.

Once the image(s) are captured by the mobile communication device 101, they may be uploaded to the server 200 for tire tread analysis (step 730). A scan of the tires can uncover interesting information about the state of a vehicle's tires, steering and suspension. These digital images can calculate the tread wear depths and patterns, then the calculations can be processed with diagnostics and for the assessment of vehicle alignment, steering, suspension, tire condition and rotation recommendation. Using digital imaging and VIN and/or tire identification number (TIN, which may be used for safety recall tracking), for example, an analysis of tire tread depth/wear may be undertaken, which may include assessing over/under inflation, camber, caster, toe, and/or suspension/shock issues, for example. The tire tread analysis may be conducted, for example, by comparing one or more image features to one or more thresholds established from known data and/or by inputting one or more image features to a machine learning model. In some cases, the tire tread analysis may be a part of the symptomatic diagnosis described above, with the image(s) or features thereof being used as a symptom together with other symptoms (sound/vibration and/or user input). The output of the tire tread analysis (and/or symptomatic diagnosis) may then be received by the app 100 and displayed to the user, for example, in the form of tire tread condition information report (step 740). Such a report may, for example, indicate that tires are in need of repair or that new tires are needed or provide a recommended timelines for replacing tires. Repair recommendations resulting from depth and wear analysis may include recommendations to replace tire(s), rotate tires, perform vehicle alignment, replace shocks, and/or replace steering and suspension components, for example. In some cases, it may be recommended to replace a tire when it is not possible or not practical to repair tire damage caused by a road hazard, such as when the tire is over six years old or when road debris lodged in the tire is too big (e.g., more than one-quarter inch) or is too close to the tire's edge (e.g., less than one-half inch). In a case where the output of the tire tread analysis is used as part of a symptomatic diagnosis of the vehicle 30, the symptomatic diagnostic condition information received by the app 100 from the server 200 and displayed as described above (and/or used to build a machine learning model) may include one or more items that are at least in part derived from the tire tread analysis.

Upon viewing tire tread condition information presented by the app 100 on the mobile communication device 101 (e.g., in a report as described above), the user may be presented with an option to repair a defect indicated by the tire tread condition information. This may proceed in the same way as described above in relation to requesting repair services, auto parts, or roadside assistance. For example, in response to the vehicle owner's interaction with the "get service" button 142 (see FIG. 3) or a corresponding button of a tire condition report in a case where the report is tire-specific, the app 100 may transition to the third (center-right) and fourth (right-most) views of FIG. 3, where the app 100 may display a list of third-party providers 500 having the capability to repair the defect and/or replace the tires. When the vehicle owner has made his or her decision, he or she may tap the button 152 ("GO") to be directed to the selected third-party provider 500 in the same way as described above, for example, with the app 100 receiving a geolocation of the specified provider 500 and displaying it on the mobile communication device 101.

The tire tread analysis my additionally include a comparison of the one or more images and/or image feature(s) to modelled tire degradation based on the tire manufacturer's recommended mileage life. The modelled tire degradation may comprise, for example, a linear degradation over the tire lifecycle, and the inbound images captured by the mobile communication device 101 may be compared to this assumed/modeled degradation in order to make recommendations to the user based on the expected life of the tire. Such analysis can inform the user as to how his/her tires are doing vs. how they should be doing at a given point in the tire lifecycle. The results could further be stored by the server 200 in the user profile 20 associated with the specific driver and vehicle 30. The results may depend, for example, on how the particular driver handles the vehicle (e.g., whether he/she drives aggressively, accelerates rapidly, etc.) and on what surfaces the particular vehicle 30 is typically driven, for example. Over time, trends in tire degradation of a specific driver and/or vehicle 30 relative to modeled degradation may be used to accurately predict when tires will need to be replaced or repaired. The server 200 and/or app 100 could then predict tire change periods ahead of time, rather than just judging current tire degradation, even without the use of any current image data (and the predictions may be refined as image data is collected). Appropriate offers for upcoming tire replacement/repair (e.g., based on location of nearby service centers, etc.) could then be presented to the user via the app 100.

Yet another source of information about the user's vehicle 30 that is contemplated by the present disclosure is tire pressure sensor data. In this regard, the app 100 may be operable to derive tire pressure data associated with the vehicle 30 from an analysis of one or more tire pressure signals received by the mobile device 101 (e.g., over a short-range wireless connection such as a Bluetooth connection). In some cases, the app 100 may interface directly with a plurality of individual tire pressure sensors 34 in the tires, receiving a respective signal from each sensor 34. Instead, or in addition to this, the app 100 may be capable of interfacing with a signal receiver 36 that may be installed in the vehicle 30. The signal receiver 36 may receive the individual tire pressure signals from each tire, which may be in a variety of formats depending on the particular sensors 34 deployed and settings thereof. The signal receiver 36 may function to translate or otherwise convert the tire pressure signals to a format that is suitable for analysis by the app 100, which may then receive the converted tire pressure signal(s) from the receiver 36. Based on the tire pressure signal(s), the app 100 may present tire pressure information to the user on the mobile communication device 101, such as in the form of a diagram of the vehicle 30 showing respective pressure amounts next to each of the four tires. The app 100 may also issue alerts to the user when tire pressure is outside of a manufacturer-recommended range. Example tire pressure sensor functionality, including the use of a receiver in relation to a universal tire pressure monitor, can be found in U.S. Pat. No. 7,518,495, filed Nov. 18, 2003 and entitled UNIVERSAL TIRE PRESSURE MONITOR, the entire contents of which is expressly incorporated herein by reference. In some cases, the app 100 may upload tire pressure sensor data to the server 200 for additional analysis, possibly in conjunction with and as part of the tire tread analysis discussed above.

In some cases, the diagnostic data stored in the user profile 20, which may be used by the app 100 to provide functionality and recommendations that are tailored to the user's specific vehicle 30 as described herein, may be collected as part of diagnostic data collection processes that are initiated outside the app 100. To illustrate one such example use case, as described in the above-mentioned '205 and '115 applications, an auto parts store might provide customers with access to kiosks 600 (e.g., in-store kiosks that may be standing kiosks or on-the-counter kiosks) that allow the customers to inspect/scan their vehicles 30 to obtain a vehicle health report (VHR). Diagnostic data may be gathered from a customer's vehicle 30 using a scan tool or dongle-connected tablet available for use at the store, either one that is attached to the kiosk 600 by a cable or one that is a separate device (e.g., provided to the customer by a store clerk) and subsequently connected to the kiosk 600 to fetch the VHR from a backend server (e.g., the server 200). The kiosk 600 may then display the VHR on a display screen of the kiosk 600 or tablet for viewing by the user, while at the same time the VHR (and/or diagnostic data) may be stored by the server 200 in the user profile 20 in association with the particular user and the user's specific vehicle 30 (e.g., using the VIN included in the diagnostic data to link the data to the appropriate user profile 20). Such a kiosk 600 may also provide the user with a copy of the report by generating a barcode as described above, without requiring the user to enter in an email or phone number as a destination of the report and without requiring the user's device to necessarily have access to the diagnostic functionality of the server 200 (such as via a URL). The kiosk 600 or tablet may simply display the QR code or other barcode encoding the diagnostic data and/or VHR itself to quickly enable the transfer of the report from the kiosk/tablet screen directly to the user's phone 101 using the camera 105. In addition, when a report is complete, the store staff could scan the displayed barcode to ingest or populate the shopping cart with the items needed directly to their point-of-sale (POS) terminals. This transfer would help staff sell and/or provide advice in relation to the necessary parts needed for service of the vehicle 10. At the same time, the user profile 20 may in this way accumulate historical diagnostic data about the user's vehicle 30, even when the app 100 is not used to perform the scan. The services of various business entities, such as auto parts stores offering such kiosks 600, may thus be enhanced through seamless integration into the app-based system described herein.

It is contemplated that the geolocation of the mobile communication device 101, which may be derived using cellular data and/or a GPS module 106 as described above, may additionally be used by the app 100 to direct location-specific coupons, sales, and other offers to the user. For example, the server 200 may connect to a database of offers, which may be pushed to the app 100 as the mobile communication device 101 moves near to a business having a relevant, current offer (or when the app 100 determines that such a business is on an expected route of the vehicle 30). The relevance of the offers to a particular user may be determined according to the information in the user profile, which may include various information input by the user, for example, personal interests, consumer habits, preferred stores, etc., in addition to the information about the user's vehicle 30 and its history. In this way, the app 100 may tailor the experience for each individual user while minimizing the presentation of unwanted offers that might otherwise be perceived as spam.

In general, the app 100 may have various features to improve the user experience and encourage use of the app 100. For example, the app 100 may include gamification features such as achievements, progress bars, badges, points, rewards, etc. A user may earn an achievement by requesting roadside assistance using the app 100, for example. The achievement or other gamification feature may then be displayed on the user profile. It is contemplated that there may be a social component to the app 100, where users may view each other's gamification features and possibly connect socially, such as by messaging or linking to third-party social media profiles. To this end, the user profile may comprise a private version, which is accessible only by the particular user and includes diagnostic information about the user's vehicle 30, and a public version, which is accessible to other users and does not include private information. The public version of the user profile may include the gamification features, for example, as well as general information about the user and/or the user's vehicle 30 to the extent permitted by the user. In this way, the app 100 may serve as a gateway to a vehicle-centric social network.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A system for providing mobile application-based vehicle diagnostics, the system comprising:

a mobile communication device having an installed mobile application, the mobile application operable to receive a first instruction to obtain vehicle condition information associated with a registered vehicle, determine a first geolocation of the mobile communication device, receive a geolocation of a specified diagnostic service provider in relation to the first geolocation of the mobile communication device in response to the first instruction, and display the geolocation of the specified diagnostic service provider on the mobile communication device;

a diagnostic tool configured to be operable by the specified diagnostic service provider to retrieve diagnostic data from the registered vehicle; and at least one server in communication with the mobile communication device and configured to be operable by a different entity than the specified diagnostic service provider to establish a user profile associated with a user of the mobile communication device and including a vehicle identification number (VIN) associated with the registered vehicle, receive the diagnostic data from the diagnostic tool operable by the specified diagnostic service provider, detect the VIN in the diagnostic data, derive vehicle condition information from the received diagnostic data, associate the vehicle condition information with the user profile by matching the VIN included in the received diagnostic data with the VIN included in the user profile, and provide the vehicle condition information to the mobile application;

wherein the mobile application displays the vehicle condition information on the mobile communication device.

2. The system of claim 1, wherein the mobile application is operable to determine whether a data acquisition and transfer device (DAT) for connecting the mobile communication device to a diagnostics port of the registered vehicle is present.

3. The system of claim 2, wherein the mobile application is operable to set an operation mode to a first mode in response to a determination that the DAT is not present and to set the operation mode to a second mode in response to a determination that the DAT is present, wherein, when the operation mode is set to the first mode, the mobile application is operable to estimate a distance traveled by the mobile communication device based on a signal received by a GPS module of the mobile communication device, and, when the operation mode is set to the second mode, the mobile application is operable to retrieve mileage data from the registered vehicle via the DAT and correct the estimated distance using the retrieved mileage data.

4. The system of claim 3, wherein, when the operation is set to the first mode, the mobile application estimates the distance on a necessary condition that the mobile communication device is within range of a wireless signal transmitted by the registered vehicle.

5. The system of claim 2, wherein the DAT is configured to communicate with the vehicle using an ELM327 command protocol.

6. The system of claim 1, wherein the mobile application determines a second geolocation of the mobile communication device, and the at least one server provides the mobile communication device with a geolocation of a specified auto repair service provider in relation to the second geolocation of the mobile communication device, the specified auto repair service provider having a capability to repair a defect indicated by the vehicle condition information.

7. The system of claim 6, wherein the at least one server further provides an information package derived from the vehicle condition information to the specified auto repair service provider.

8. The system of claim 7, wherein the at least one server receives a bid for repairing the defect from the specified auto repair service provider and provides the bid to the mobile application, and the mobile application displays the bid on the mobile communication device.

9. The system of claim 7, wherein the server scrubs sensitive information from the vehicle condition information to derive the information package.

10. The system of claim 6, wherein the at least one server provides the mobile communication device with contact information of the specified auto repair service provider, and the mobile application is operable to initiate a phone call from the mobile communication device to the specified auto repair service provider using the contact information.

11. The system of claim 1, wherein the mobile application determines a second geolocation of the mobile communication device, and the at least one server provides the mobile communication device with a geolocation of a specified auto parts provider in relation to the second geolocation of the mobile communication device, the specified auto parts provider having a part suitable to repair a defect indicated by the vehicle condition information.

12. The system of claim 11, wherein the at least one server further provides an information package derived from the vehicle condition information to the specified auto parts provider.

13. The system of claim 12, wherein the at least one server receives a bid for the part suitable to repair the defect from the specified auto parts provider and provides the bid to the mobile application, and the mobile application displays the bid on the mobile communication device.

14. The system of claim 12, wherein the server scrubs sensitive information from the vehicle condition information to derive the information package.

15. The system of claim 11, wherein the at least one server provides the mobile communication device with contact information of the specified auto parts provider, and the mobile application is operable to initiate a phone call from the mobile communication device to the specified auto parts provider using the contact information.

16. The system of claim 1, wherein the mobile application determines a second geolocation of the mobile communication device, and the at least one server provides the mobile communication device with contact information of a specified roadside assistance service provider in relation to the second geolocation of the mobile communication device, the specified roadside assistance service provider having a capability to provide roadside assistance in relation to a defect indicated by the vehicle condition information.

17. The system of claim 16, wherein the at least one server further provides an information package derived from the vehicle condition information to the specified roadside assistance service provider.

18. The system of claim 17, wherein the at least one server receives a bid for providing roadside assistance in relation to the defect from the specified roadside assistance service provider and provides the bid to the mobile application, and the mobile application displays the bid on the mobile communication device.

19. The system of claim 17, wherein the server scrubs sensitive information from the vehicle condition information to derive the information package.

20. The system of claim 16, wherein the at least one server provides the mobile communication device with contact information of the specified roadside assistance service provider, and the mobile application is operable to initiate a phone call from the mobile communication device to the specified roadside assistance service provider using the contact information.

21. The system of claim 1, wherein the mobile application is further operable to derive symptom data associated with the registered vehicle from an analysis of engine noise sensed by a microphone of the mobile communication device.

22. The system of claim 21, wherein the at least one server is further operable to receive the symptom data from the mobile communication device and train a machine learning model using the received symptom data.

23. The system of claim 22, wherein the at least one server trains the machine learning model using the received symptom data and the received diagnostic data.

24. The system of claim 1, wherein the mobile application is further operable to derive symptom data associated with the registered vehicle from an analysis of engine vibration sensed by an accelerometer of the mobile communication device.

25. The system of claim 24, wherein the at least one server is further operable to receive the symptom data from the mobile communication device and train a machine learning model using the received symptom data.

26. The system of claim 25, wherein the at least one server trains the machine learning model using the received symptom data and the received diagnostic data.

27. The system of claim 1, wherein the mobile application is further operable to receive a second instruction to obtain tire tread condition information and, in response to the second instruction, upload to the at least one server one or more images of a tire of the registered vehicle captured by a camera of the mobile communication device, and the at least one server is operable to derive tire tread condition information from the one or more images and provide the tire tread condition information to the mobile application.

28. The system of claim 27, wherein, in response to the second instruction, the mobile application displays guidance on the mobile communication device for capturing the one or more images using the camera of the mobile communication device.

29. The system of claim 28, wherein the guidance includes feedback to the mobile application based on detected objects within a view of the camera.

30. The system of claim 27, wherein the tire tread condition information derived by the at least one server comprises an assessment of one or more items selected from the group consisting of alignment, steering, suspension, tire condition, and tire rotation.

31. The system of claim 27, wherein the tire tread condition information derived by the at least one server comprises a comparison of at least one feature of the one or more images to modelled tire degradation based on a manufacturer-recommended mileage life of the tire.

32. The system of claim 31, wherein the comparison includes a prediction of when the tire will need to be replaced.

33. The system of claim 27, wherein the mobile application determines a second geolocation of the mobile communication device, and the at least one server provides the mobile communication device with a geolocation of a specified third party provider in relation to the second geolocation of the mobile communication device, the specified third party provider having a capability to repair a defect indicated by the tire tread condition information.

34. The system of claim 27, wherein the mobile application determines a second geolocation of the mobile communication device, and the at least one server provides the mobile communication device with a geolocation of a specified third party provider in relation to the second geolocation of the mobile communication device, the specified third party provider having a capability to replace a tire having a defect indicated by the tire tread condition information.

35. The system of claim 1, wherein the mobile application is further operable to derive tire pressure data associated with the registered vehicle from an analysis of at least one tire pressure signal received by the mobile communication device.

36. The system of claim 35, wherein the at least one tire pressure signal comprises a plurality of signals from a plurality of tire pressure sensors disposed in respective tires of the registered vehicle.

37. The system of claim 35, wherein the mobile application interfaces with a signal receiver, external to the mobile communication device, that receives a plurality of signals from a plurality of tire pressure sensors disposed in respective tires of the registered vehicle.

38. The system of claim 1, wherein the at least one server is further operable to push a location-specific offer from a database of offers to the mobile application based on the first geolocation of the mobile communication device.

39. The system of claim 38, wherein the server selects the location-specific offer based on a relevance determined according to information in the user profile associated with the user of the mobile communication device.

40. The system of claim 1, wherein the mobile application includes at least one gamification feature selected from the group consisting of achievements, progress bars, badges, points, and rewards.

41. The system of claim 1, wherein the diagnostic tool is further operable to generate a barcode encoding the retrieved diagnostic data, and the mobile application is further operable to decode the diagnostic data based on an image of the barcode captured by a camera of the mobile communication device.

42. The system of claim 41, wherein the barcode is a two-dimensional barcode.

43. The system of claim 42, wherein the two-dimensional barcode is a QR code.

44. The system of claim 1, further comprising:

a kiosk configured to be operable by an auto parts provider to retrieve additional diagnostic data from the registered vehicle, wherein the at least one server is further operable to receive the additional diagnostic data from the kiosk, detect the VIN in the additional diagnostic data, derive additional vehicle condition information from the additional diagnostic data, and associate the additional vehicle condition information with the user profile by matching the VIN included in the additional diagnostic data with the VIN included in the user profile.

45. The system of claim 44, wherein the kiosk is operable to generate a barcode encoding the additional diagnostic data, and the mobile application is further operable to decode the additional diagnostic data based on an image of the barcode captured by a camera of the mobile communication device.

46. The system of claim 45, wherein the barcode is a two-dimensional barcode.

47. The system of claim 46, wherein the two-dimensional barcode is a QR code.

48. A method of providing mobile application-based vehicle diagnostics, the method comprising:

establishing a user profile associated with a user of a mobile communication device and including a vehicle identification number (VIN) associated with a registered vehicle;

receiving, from the mobile communication device, a first geolocation of the mobile communication device;

providing, to a mobile application installed on the mobile communication device, a geolocation of a specified diagnostic service provider in relation to the first geolocation of the mobile communication device;

receiving diagnostic data of the registered vehicle from a diagnostic tool operable by the specified diagnostic service provider;

detecting the VIN in the diagnostic data;

deriving vehicle condition information from the received diagnostic data;

associating the vehicle condition information with the user profile by matching the VIN included in the received diagnostic data with the VIN included in the user profile; and providing the vehicle condition information to the mobile application.

49. A non-transitory program storage medium on which are stored instructions executable by a processor or programmable circuit of at least one server to perform operations for providing mobile application-based vehicle diagnostics, the operations comprising:

establishing a user profile associated with a user of a mobile communication device and including a vehicle identification number (VIN) associated with a registered vehicle;

receiving, from the mobile communication device, a first geolocation of the mobile communication device;

providing, to a mobile application installed on the mobile communication device, a geolocation of a specified diagnostic service provider in relation to the first geolocation of the mobile communication device;

receiving diagnostic data of the registered vehicle from a diagnostic tool operable by the specified diagnostic service provider;

detecting the VIN in the diagnostic data;

deriving vehicle condition information from the received diagnostic data;

associating the vehicle condition information with the user profile by matching the VIN included in the received diagnostic data with the VIN included in the user profile; and providing the vehicle condition information to the mobile application.

* * * * *